United States Patent [19]

Jones et al.

[11] 4,187,779

[45] Feb. 12, 1980

[54] MARINE MINE

[75] Inventors: Harry S. Jones, East Orange, N.J.; David B. Kirkpatrick, Oreland, Pa.; Robert G. Wilson, Washington, D.C.

[73] Assignee: The United States of America as represented by the Secretary of the Navy, Washington, D.C.

[21] Appl. No.: 589,228

[22] Filed: Apr. 19, 1945

[51] Int. Cl.[2] ..... F42B 22/04

[52] U.S. Cl. ..... 102/18 M

[58] Field of Search ..... 102/7, 16, 17, 18

[56] References Cited

U.S. PATENT DOCUMENTS

| | | | |
|---|---|---|---|
| 1,382,374 | 6/1921 | Maxim | 102/18 |
| 1,407,653 | 2/1922 | Hammond | 102/18 |
| 1,448,976 | 3/1923 | Palmer | 102/18 |

FOREIGN PATENT DOCUMENTS

| | | | |
|---|---|---|---|
| 29013 | 1/1925 | France | 102/18 |

*Primary Examiner*—Charles T. Jordan

*Attorney, Agent, or Firm*—R. S. Sciascia; A. L. Branning

EXEMPLARY CLAIM

1. In a pressure responsive mine having a casing and an arming and firing circuit therein, a pressure responsive device mounted in the casing and exposed to the pressure of the sea water, a second pressure responsive device mounted in the casing, a fluid connection between the first and second pressure responsive devices, a third pressure responsive device mounted in the casing, a restricted fluid pressure responsive connection between the second and third pressure responsive devices, and a circuit making and breaking device positioned in the restricted connection between the second and third pressure responsive devices and connected in the arming and firing circuit.

19 Claims, 10 Drawing Figures

MARINE MINE

This invention relates to a marine mine and more particularly to a combination influence marine mine in which the mine is armed and fired by changes in hydrostatic pressure caused by changes in the water velocity beneath a moving vessel and changes in the terrestrial magnetism adjacent thereto caused by the moving vessel.

An object of this invention is to provide a mine which is armed in response to the pressure field of a passing vessel and fired in response to the magnetic field of such vessel, or conversely.

Another object is to provide a pressure responsive mine firing apparatus which will be certain in operation in response to the pressure field of a passing vessel but which will not be operated in response to the intermittent pressure resulting from trains of waves or tides.

Another object is to provide a mine which is actuated in response to the pressure field of a passing vessel and which is suitable for planting at depths of forty (40) to one hundred and twenty (120) feet and is sensitive within this range of depths to the pressure signatures of vessels of 5,000 tons or more traveling at a speed of at least two knots.

Another object is to provide a pressure responsive mine which may be armed in response to the pressure field or the magnetic field of a passing vessel, as the case may be, and in which the detecting mechanism will withstand the shock of impact of the mine against the water when the mine is planted from airplane.

Another object of the invention is to provide a pressure responsive mine which is armed in response to the pressure field of a passing vessel and in which the arming apparatus is hydraulic in nature and operable regardless of the position in which the mine comes to rest on the bed of the body of water within which the mine is planted.

A further object is to provide a pressure responsive mine which is armed in response to the pressure wave of a passing vessel and is fired in response to the magnetic field of such vessel and in which the magnetically controlled firing means is capable of operation in any position in which the mine comes to rest.

A still further object of the present invention is to provide a pressure responsive mine which is operated in response to the pressure field of a passing vessel and fired in response to the magnetic field of such vessel, and in which the pressure controlled arming means operates only in response to pressure waves having periods of greater than ten seconds and amplitudes of the order of those developed by vessels of 5,000 tons or more displacement at the above referred to depths, whereby sweeping of the mine by any of the present known methods becomes substantially impossible.

Still another object of the present invention is to provide a pressure responsive combination mine arming and firing mechanism which is operated in response to both the pressure field of a passing vessel and the magnetic field of such vessel detected by the mechanism and in which an arming circuit is selectively controlled by the pressure field or the magnetic field of the moving vessel, whichever may be first detected, and a firing circuit is closed within a predetermined period of time thereafter in response to the field of the vessel last detected.

Still other objects, advantages, and improvements will be apparent from the following description, taken in connection with the accompanying drawings, in which.

Figure 6:
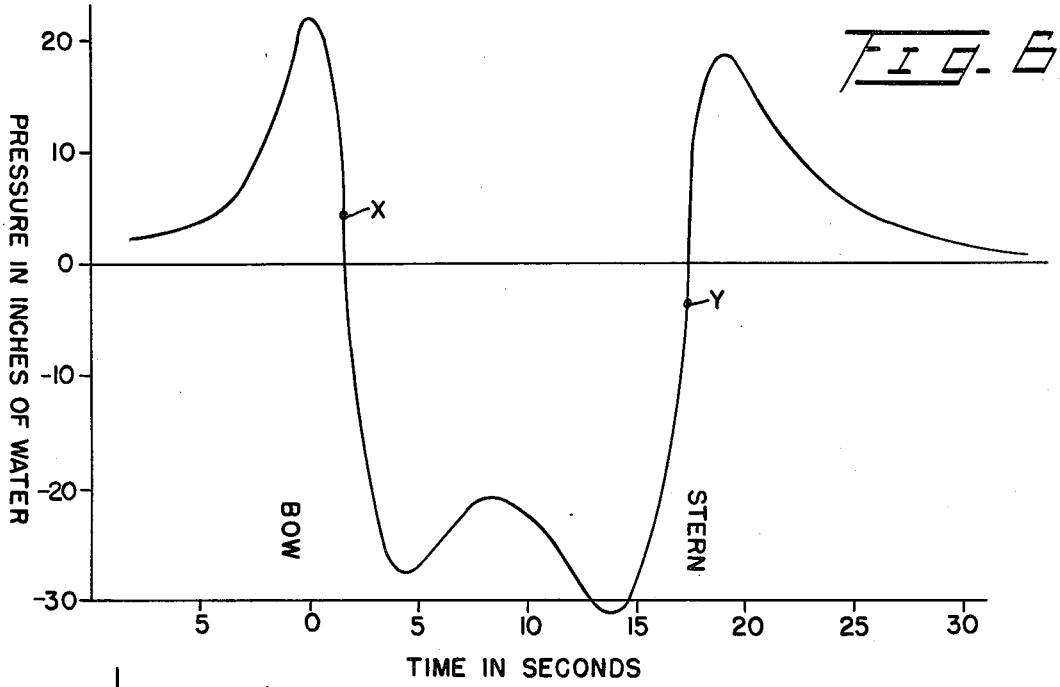
Figure 7:
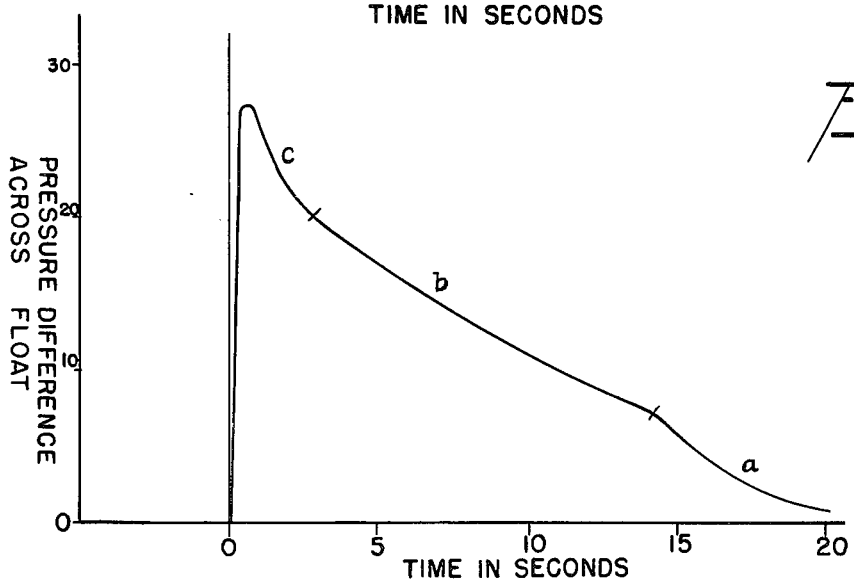

FIG. 6 is a graph showing the pressure wave or signature of a vessel as it moves through the water, the actual points at which the contacts of the micro contact switch detector device open and close being indicated at x and y; and, FIG. 7 is another graph showing the pressure difference across the float of the micro contact switch detector device as a function of the duration of the pressure wave of a passing vessel.

Figure 1:
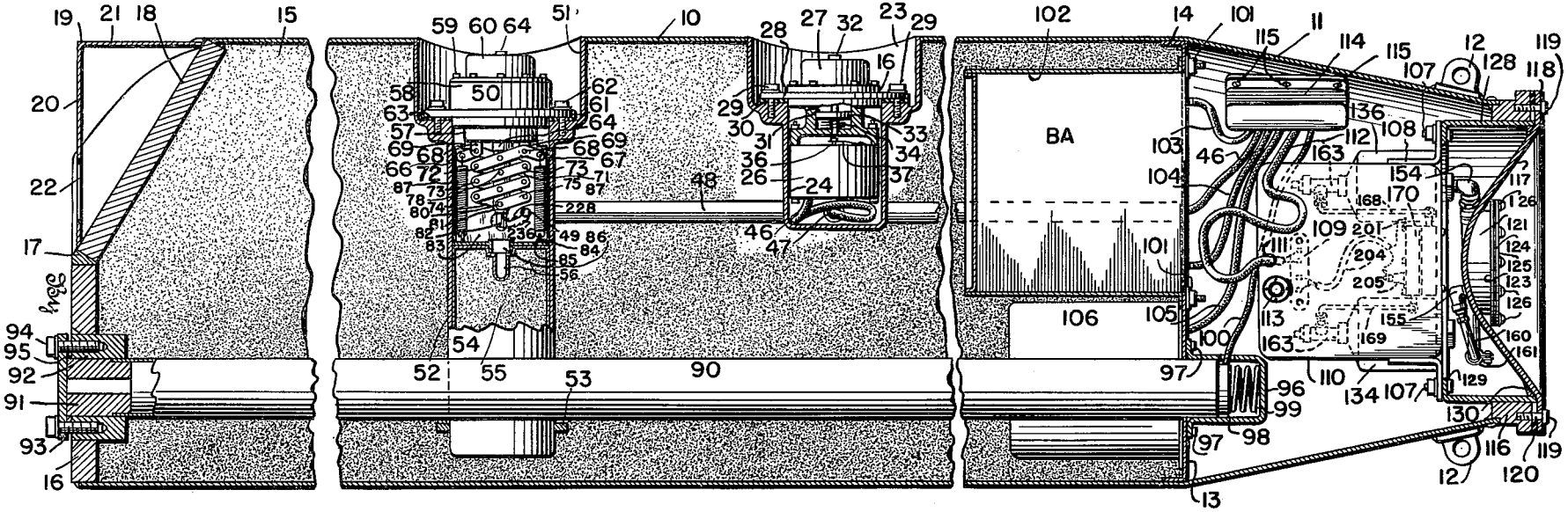
FIG. 1 is a vertical sectional view through a mine embodying the present invention and showing in particular the pressure responsive sea facing chamber mounted in the nose of the mine, the timing device, and the extender mechanism for inserting the detonator into the booster charge.
Figure 2:
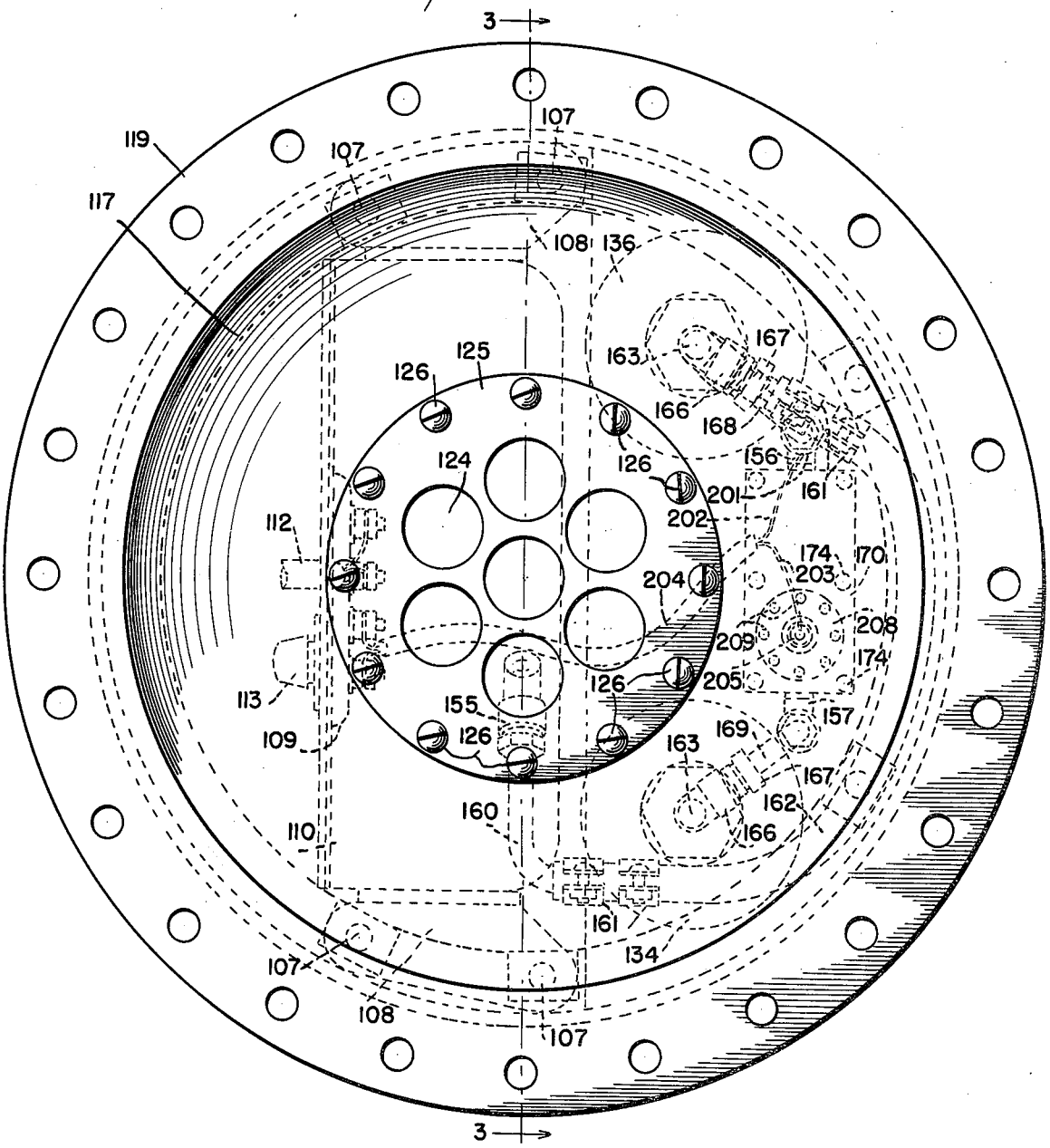
FIG. 2 is an end elevation view of the pressure responsive sea facing chamber mounted in the nose of the mine, this view being taken looking toward the left in FIG. 1.

Referring now to the drawings for a more complete understanding of the invention and more particularly to FIG. 1 thereof, there is here shown a mine having a main casing section 10 and a rearwardly extending frusto-conical section 11. This latter section is provided with a plurality of eyelet members 12 secured thereto in any suitable manner, as by spot welding. The function of these eyelet members is to facilitate attachment of the mine to a parachute when the mine is being planted from an airplane, the parachute being adapted to be detached from the mine casing in any well known manner when the mine strikes the surface of the water. The rearwardly extending section 11 of the mine casing is closed by a shouldered ring 116 secured in any suitable manner, as by brazing, soldering, welding, or the like, in the end of this portion. The interiors of the main and rear casing sections 10 and 11 are separated by a bulkhead 13 positioned at their juncture, the interior of the casing section 10 being filled with the usual high explosive charge 15 and the interior of the rear casing section 11 forming an instrument compartment. The bulkhead 13 has a circumferential inwardly turned flange 14 extending inside the casing section 10 and secured thereto in any suitable manner.

The front end of the mine is so constructed that it presents the usual cylindrical contour when in flight through the air but upon striking the water a section of the casing is detached and the changed contour of the mine casing then checks the descent of the mine through the water. A detailed description of this structure will be found in the copending application of J. S. Thompson et al for Marine Mine, Ser. No. 523,088, filed Feb. 19, 1944. As shown here the construction consists of a closure plate 16 of semicircular shape and a second plate 18 inclined at an angle thereto, the two plates forming a closure for the front end of the mine casing. The plates 16 and 18 are secured to the mine casing 10 in any suitable manner and to each other as by welding at 17, so as to form water tight joints between the plates and the casing and between the two plates themselves.

There is also provided a faired member 19 comprising a semicircular flat plate 20 and a curved plate 21 secured thereto. The faired member 19 is attached to the front portion of the mine casing substantially at the welded juncture 17 of the plates 16 and 18 and to the mine casing 11 substantially at the juncture of the plate 18 and the casing, as by spot welding. As thus constructed the mine presents a symmetrical front to the air when released from an aircraft in flight thereby maintaining the trajectory of the mine along a predetermined path of travel through the air. The plate 20 is provided with a pair of apertures 22 which admit water to the interior of the faired member 19 and cause this member to be ripped clear of the mine casing as the mine strikes the surface of the water thereby exposing the surface of the plate 18 to the action of the water. The plate 18 now presents to the water a control surface disposed at an angle with respect to the direction of motion of the mine and the pressure of the water against this control surface causes the mine to veer and pursue a different course within the water. In this course the axis of the mine is turned substantially normal to the path of travel and thus the velocity of the mine within the water is quickly checked sufficiently to reduce the vertical component of the velocity of the mine within the water to the terminal velocity of the mine within the water or to a value less than the terminal velocity of the mine within the water. The terminal velocity, as employed herein, may be defined as the maximum rate of descent of the mine within the water when the downward movement of the mine within the water is effected solely by the gravitational pull on the mine during the time when the mine is submerged.

When the downward movement of the mine has been substantially arrested as the result of change in the angular position of the axis of the mine with respect to the path of travel thereof in response to the pressure of the water against the control surface of the plate 18, the mine sinks within the water at a greatly reduced rate of travel and comes to rest on the bed of the body of water without damage or injury to the casing or to the arming and firing apparatus therein, the force of impact of the mine against the bed being insufficient to cause the mine to be buried within the bed.

Two aligned hatches 23 and 51 are formed in the main casing section 10. The clock 25 is mounted in an extension 24 of the rearward hatch 23, this device being enclosed by a casing 26 and an upper section 27 of this casing being positioned within the hatch itself. The casing 26 has a circumferential flange 28 with suitable arcuately spaced holes therein through which screws 29 extend into the bottom wall of the hatch. A gasket 30 of suitable material, for instance Neoprene, is positioned between the flange 28 and the bottom wall of the hatch. The upper section 27 of the casing 26 has a counterbore 31 formed concentrically thereof and a clock releasing plunger 32 extends through a central hole in the bottom wall of this counterbore. The plunger 32 has a collar 33 affixed thereto and a compression spring 34 is positioned between this collar and the bottom wall of the counterbore, encompassing the plunger 32. A diaphragm 35 (FIG. 5) is positioned in the upper section 27 of the casing and exposed to the pressure of the sea water, which enters the upper casing section through suitable apertures in the latter, and is attached centrally to the releasing plunger 32. Normally the releasing plunger 32 is held in its uppermost position by a water soluble washer (not shown) mounted in the upper section 27 of the casing and surrounding the plunger. This washer is made of some material suitable for the purpose such, for example, as a composition of salt, lime, glycerine, and glue or shellac, the percentage of either of the latter two ingredients determining the rate of dissolution of the washer.

A detailed description of the clock 25 will be found in the copending application of James B. Glennon et al for a Firing Mechanism for a Submarine Mine, Ser. No. 395,230, filed May 26, 1941. As shown here, this device consists of a spring motor within the casing 26. A stop pin 36 is positioned in alignment with the releasing plunger 32 and biased upwardly by the leaf spring 37. This stop pin 36 engages the escapement wheel (not shown) of the spring motor (also not shown) and is adapted in turn to be engaged by the releasing plunger 32. After the mine has been planted in the water for some time, for instance two or three hours, the water soluble washer will become dissolved, the releasing plunger 32 will be freed, and the water pressure operating on the diaphragm 35, FIG. 5, will force the plunger downwardly against the action of the compression spring 34 and into engagement with the stop pin 36, thereby releasing the spring motor for operation.

Figure 5:
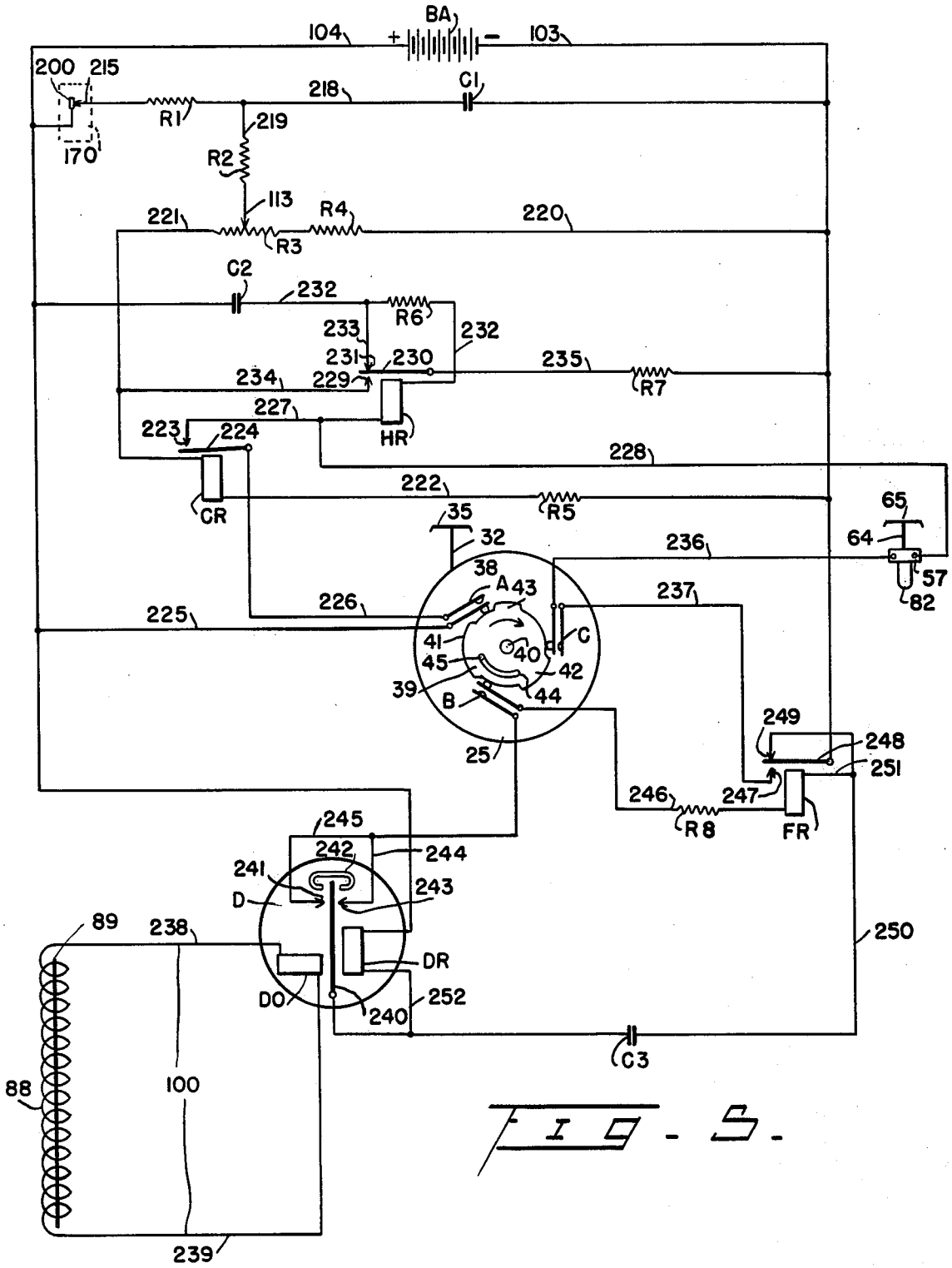
FIG. 5 is a circuit diagram showing the arming and firing circuit, this circuit comprising principally four relays, the micro contact switch detector device, extender mechanism, clock, battery, and search coil of the magnetically responsive firing means.

Referring now to FIG. 5, it will be seen that the circuit making and breaking parts operated by the clock 25 consist of a fixed plate 38, a concentrically disposed three lobe cam 39 mounted on a shaft 40 which latter projects through the plate and is driven by the spring motor (not shown) and three sets of arcuately spaced contacts A, B, and C, the lobe 41 being adapted to close the set of contacts A, the lobe 42 being adapted to close the set of contacts B, and the lobe 43 being adapted to close the set of contacts C. An arcuate slot 44 is formed in the cam 39 and a pin 45, mounted in the plate 38, projects into this slot, this pin and slot connection limiting the angular movement of the cam 39. When the plunger 32 abuts the stop pin 36 and releases the spring motor for operation, the cam 39 is rotated until arrested by the end of the slot 44 in the cam moving into contact with the pin 45. The rotary movement of the cam 39 causes the contacts A to be closed at a predetermined time, for example an hour after the plunger 32 has been released, and the contacts B to be closed at the expiration of a subsequent interval of time, for example an hour after the contacts A have been closed, and the contacts C to be closed at the expiration of a still subsequent interval of time, for instance an hour after the contacts B have been closed. Contacts A, B, and C, are prevented from re-opening by the cam 39 being brought to rest as the pin 45 mounted in the plate 38 engages the end of the slot 44 in the cam. A cable 46, FIG. 1, containing the requisite number of leads (six) extends from the clock 25 to the instrument compartment in the rear section 11 of the mine casing.

In the system of the present invention a hydrostat and a lazy tongs are provided for moving the detonator and inserting same into booster charge. Normally, that is before the mine is planted, the detonator is positioned at a safe distance from the booster charge. The flexible diaphragm of the hydrostat is exposed to the pressure of the sea water and the relatively small movement of this diaphragm is multiplied by the lazy tongs and transmitted to the detonator. A detailed description and illustration of the hydrostat and lazy tongs will be found in the copending application of Albert H. Sellman et al for Hydraulic Mechanism, Ser. No. 432,454, filed Feb. 26, 1942. As shown here, this device, generally designated by the reference numeral 50, is mounted in the forward hatch 51 and in an extension 52 of the latter which projects diametrically of the main section 11 of the mine casing. The hydrostat part of the device is enclosed by a casing 57, mounted in the extension 52 of the hatch, and an upper section 58 positioned in the hatch itself, and a cap 60 mounted on the upper section 58 by screws 59. The casing has a flange 61 intermediate the lower section 57 and the upper section 58 and suitable arcuately spaced holes are provided in this flange through which screws 62 project into the bottom wall of the hatch. A gasket 63 of suitable material, for instance Neoprene, is positioned between the flange 61 and the bottom wall of the hatch. The extension 52 of the hatch 51 is supported adjacent its bottom by cross braces 53 which extend chordally of the main section 11 of the mine casing. A can 54 containing the detonating charge 55 fills the bottom of the extension 52 and this can has a central depression 56 in its top suitably formed to receive the detonator 82, as will be later described.

A plunger 64 extends centrally of the casing 57, upper section 58, and the cap 60. A diaphragm 65, FIG. 5, is affixed adjacent to the upper end of the plunger 64 and secured in the upper section 58 of the hydrostat casing where it is exposed to the pressure of the sea water entering through apertures (not shown) in the cap 60. A water soluble washer (also not shown), similar to the washer previously described in connection with the clock 25, is positioned in the cap 60 and around the plunger 64. This washer normally, that is, before the mine has been planted and after it has been planted and prior to the time that the washer becomes dissolved, restrains the plunger from downward movement.

The lazy tongs mechanism consists of a pair of upper levers 66 and 67 which are pivoted adjacent their outer ends at 68 to ears or lugs 69 formed on the under face of the casing 57. The levers 66 and 67 are also pivoted at approximately their mid-sections to the plunger 64, as at 78. There is also provided a U-shaped member 83, the sides of which are secured at their upper ends to the bottom of the casing 57 by suitable screws (not shown) and between which sides the lower end of the plunger 64 is adapted to reciprocate. The bottom or trough of the U-shaped member 83 is formed as a flat plate 84 and this plate has ears or lugs 85 extending upwardly at its opposite sides. Coil tension springs 87 are each attached at their lower ends to the ears or lugs 85 on the bottom plate 84 of the U-shaped plate member 83 and at their upper ends to the outer ends of the upper levers 66 and 67, respectively. It will be noted that the lever arms between the movable center pivot 78 and either of the fixed pivots 69 are much longer than the corresponding lever arms between the fixed pivots and the points of attachment of the springs 87 on the outer ends of the upper levers 66 and 67, respectively. The bottom plate 84 of the U-shaped member 83 also has a hollow boss or collar 86 formed centrally thereof through which the detonator 82 is adapted to be projected, as will be later described.

Parallel link members 71 are ranged downwardly toward the bottom plate 84 of the U-shaped plate member 83 and sloped at an acute angle; complementary parallel link members are likewise ranged downwardly toward the bottom plate 84 of the U-shaped plate member 83 and are positioned at the same acute angle but with a negative slope. The uppermost link member 70 is pivoted at one end to the inner end of the upper lever 67 as at 72, at its center to the uppermost complementary link member at the center of the latter as at 78, and at its other end to one end of the next lower complementary link member as at 73; similarly, the next lower link member 71 is pivoted at one end to one end of a complementary link member as at 72, at its center to an intermediate complementary link member at the center of the latter as at 78, and at its other end to one end of the next lower complementary link member as at 73. The lowermost link member 74 of one series is only half the length of the link members ranged above the same and at its inner end is pivoted at 80 to a slideable block 81, the pivot 80 being vertically aligned with the center pivots 78 between the complementary link members 71. The slideable block 81 has a cylindrical axial bore therein adapted to receive the detonator 82. In like manner the uppermost complementary link member 71 is pivoted at one end to the inner end of the upper lever 66 as at 73, at its center to the uppermost complementary link member 70 at the center of the latter as at 78, and at its other end to the next lower complementary link member as at 72; similarly, the next lower complementary parallel link member is pivoted at one end to one end of a complementary link member as at 73, at its center to an intermediate complementary link member at the center of the latter as at 78, and at its other end to the end of the next lower complementary link member as at 72. Likewise the lowermost link member 75 of the other series is only one half the length of the link members ranged above the same and at its inner end is pivoted at 80 to the slideable block 81 which carries the detonator 82.

The slidable block 81 and the detonator 82 are held in the retracted position by the coil springs 87 secured between the ears or lugs 85 on the bottom plate 84 of the U-shaped plate member 83 and the outer ends of the upper levers 66 and 67, respectively. The pressure of the sea water on the diaphragm 65 acts through the plunger 64 and is amplified by the lazy tongs mechanism 71 and transmitted thereby to the slideable block 81 and the detonator 82 carried by the latter and impels the detonator through the hollow boss or collar 86 in the bottom plate 84 of the U-shaped member 83 and into the depression 56 in the top of the can 54 containing the detonating charge 55.

By employing relatively long springs 87 and the ratio of the lever arm lengths as shown between the movable pivot 78 and the fixed pivots 69, and between the latter and the outer ends of the upper levers 66 and 67, where the springs 87 are attached, the movement of the springs is less than the degree of movement of the flexible diaphragm 65, and, as a result of the relatively great length of these springs and the small degree of elongation thereof, the pressure applied to the plunger 64 by the springs is substantially uniform throughout the range of operation of the hydrostat mechanism. Furthermore, by employing the symmetrical arrangement of two springs, as illustrated, the mechanism is dynamically balanced and the plunger 64 may be moved inwardly or outwardly, as the case may be, without excessive friction or binding of parts and thus an arrangement results in which the mechanism is invariably reliable in operation in response to pre-determined variations in the pressure on the diaphragm exerted by the water in which the mine is submerged.

A conduit 48 extends from the bulkhead 13 past the extension 24 of the rear hatch 23 and to the extension 52 of the front hatch 51; this conduit communicates with the extension 24 through an aperture 47 in the latter and with the extension 52 through an aperture 49 in the latter. Conductors 228 and 236 from the detonator 82 extend through the aperture 49 and conduit 48 and enter the cable 46 from the clock 25, which cable enters the conduit through the aperture 47 and extends rearwardly through the conduit to the instrument compartment in the rear section 11 of the mine casing.

The magnetically responsive arming means includes an induction or pick-up coil 88 comprising a large number of turns of fine wire wound around an iron rod 89 (FIG. 5) or a rod of a highly permeable alloy, such as Permalloy. The latter has a composition of approximately twelve and one half percent and eighty-seven and one half percent nickel. The coil 88 and core 89 are enclosed in a tube 90 which extends longitudinally of the main section 10 of the main section 10 of the mine casing. At its front end the tube 90 is supported by a plug 91 mounted in a suitable aperture in the front closure plate 16, the tube encompassing a suitable shouldered section of the plug. The plug 91 is in tight fitting engagement in the bore of an insert 92, this insert in turn being in tight fitting engagement in the aperture in the front plate 16. A retaining plate 93 is mounted over the end of the plug and over the insert 92, being secured to the insert by screws 94. A gasket 95 of suitable material, for instance Neoprene, is secured between the retaining plate 93 and the insert 92. At its rear end the tube 90 extends freely through a suitable hole in the bulkhead 13 and a cap 96 encloses this end, this cap being secured to the bulkhead 13 by screws 97. A plug 98 is fitted in the front end of the tube 90 and a spring 99 is positioned between the plug 98 and the cap 96 to provide a shock absorbing mounting for the tube 90. Such a mounting is highly desirable when the mine is being planted from an airplane and is subject to abrupt deceleration. A cable 100 containing the requisite number of leads (two) extends through a hole in the plug 98 and a normally aligned hole in the cap 96.

A compartment 102 in the form of a can or container of rectangular cross section is attached to the bulkhead 13 by screws 101, this compartment being adapted to house the battery BA which energizes the arming and firing circuits, to be later described. The particular battery used in these circuits is a twelve volt battery, preferably two of the four dry cell units marketed under the trade name of Hot Shot. Cables 103 and 104, carrying conductors connected to the positive and negative terminals of the battery, extend from the battery compartment 102.

A second compartment 106 in the form of a circular can or container is likewise attached to the bulkhead 13 by suitable screws (not shown) below the battery compartment 102, FIG. 1. This compartment or container 106 is adapted to contain the detecting relay D, FIG. 5. A cable 105 containing the requisite number of leads (six) extends from the relay compartment 106.

A third casing or compartment 110 is mounted inside the rear section 12 of the mine casing, by a means to be later described, and this casing encloses the micro contact detector switch device 170, the capacitors, resistors, and relays (except for the detecting relay D) of the arming and firing circuits, also to be later described. The casing 110 has an auxiliarly terminal strip 109 mounted on its interior by any suitable means, such as screws (not shown), and a cable 112, carrying the requisite number of leads, extends from this terminal strip through a hole 111 in the casing. The various components, capacitors, resistors, and relays, and the micro contact detector switch device 170 of the arming and firing circuit are connected to the terminal strip 109. A knob 113 is mounted on the exterior of the casing 110 for adjustment of a potentiometer or voltage divider R3, FIG. 5, one of the components of the arming circuit.

In order to facilitate assembly of the mine, a main terminal strip 114 is mounted as by screws 115 on the inside of the rear section 11 of the mine casing. The cable 46 from the clock 25, and from the detonator 82, the cables 103 and 104 from the battery compartment 102, and the cable 112 from the auxillary terminal strip 109 in the compartment 110 for the arming and firing circuits, all extend to the main terminal strip 114.

The previously described apparatus and structure are all more or less well known in various relationships in the explosive mine art. The apparatus and structure of the present invention, for which the previously described apparatus and structure form the background, will now be described, this description taking up successively the sea facing diaphragm, the hydraulic channel comprising the sea facing chamber, the input bellows, the micro contact switch device, and the output or back volume bellows, and the associated electrical arming and firing circuits.

Mounted centrally of the shouldered ring 116, which, as previously stated, is positioned in the end of the rear section 11 of the mine casing, there is a bowl shaped element 117 having an outwardly extending circumferential flange 118 which is secured to the ring 116 by screws 119. A gasket 120 of suitable material, for instance Neoprene, is positioned between the flange 118 and the shouldered ring 116. A diaphragm supporting cylinder 121 is mounted centrally on the bottom of the bowl shaped element 117, the cylinder having its bottom formed in arcuate shape so as to have a close fit along the entire periphery thereof in the bowl shaped element 117 and being secured thereto as by brazing, soldering, welding, or the like, as at 122, FIG. 3. The diaphragm supporting cylinder 121 has an outwardly extending circumferential flange 123 over which the sea facing diaphragm 124 is held, an apertured protecting plate 125 overlying the diaphragm, the plate and the diaphragm being held to the flange 123 by screws 126. The bottom of the bowl shaped element 117, the diaphragm supporting cylinder 121, and the sea facing diaphragm 124 together form the sea facing chamber 127. Adjacent the bottom of the bowl shaped element 117 a suitably threaded opening is provided therein and a street ell 155 is fitted into this opening, forming an inlet to and an outlet from the sea facing chamber. The diaphragm 124 is made of any suitable flexible salt water resisting material, for instance Neoprene, and has concentric annular convolutions therein which impart additional flexibility to the diaphragm.

A supporting member 128 in the form of a cylinder with an in-turned flange 129 at its bottom is mounted within the bore of the shouldered ring 116 in tight fitting relationship therein and is secured to the bowl shaped element 117 on the inner face thereof adjacent to the juncture of the main body section and the flange 118 as by brazing, soldering, welding, or the like, as at 130. To the in-turned flange 129 on the member 128 there is secured by bolts and nuts 131 a supporting plate 132, FIG. 3. The casing 110, which as previously stated, encloses the capacitors, resistors, and relays (except for the detecting relay D), and the micro contact switch device 170 of the arming and firing circuit, is mounted on the supporting plate 132 by angle brackets 108 which are secured to the casing 110, again as by brazing, soldering, welding, or the like, and to the in-turned flange 129 on the supporting member 128 by bolts and nuts 107. The supporting plate 132 also mounts the input bellows 133, and the chamber 134 therefor, the output or back volume bellows 135, and chamber 136 therefor, and the micro contact detector switch device 170, to be later described.

Figure 4:
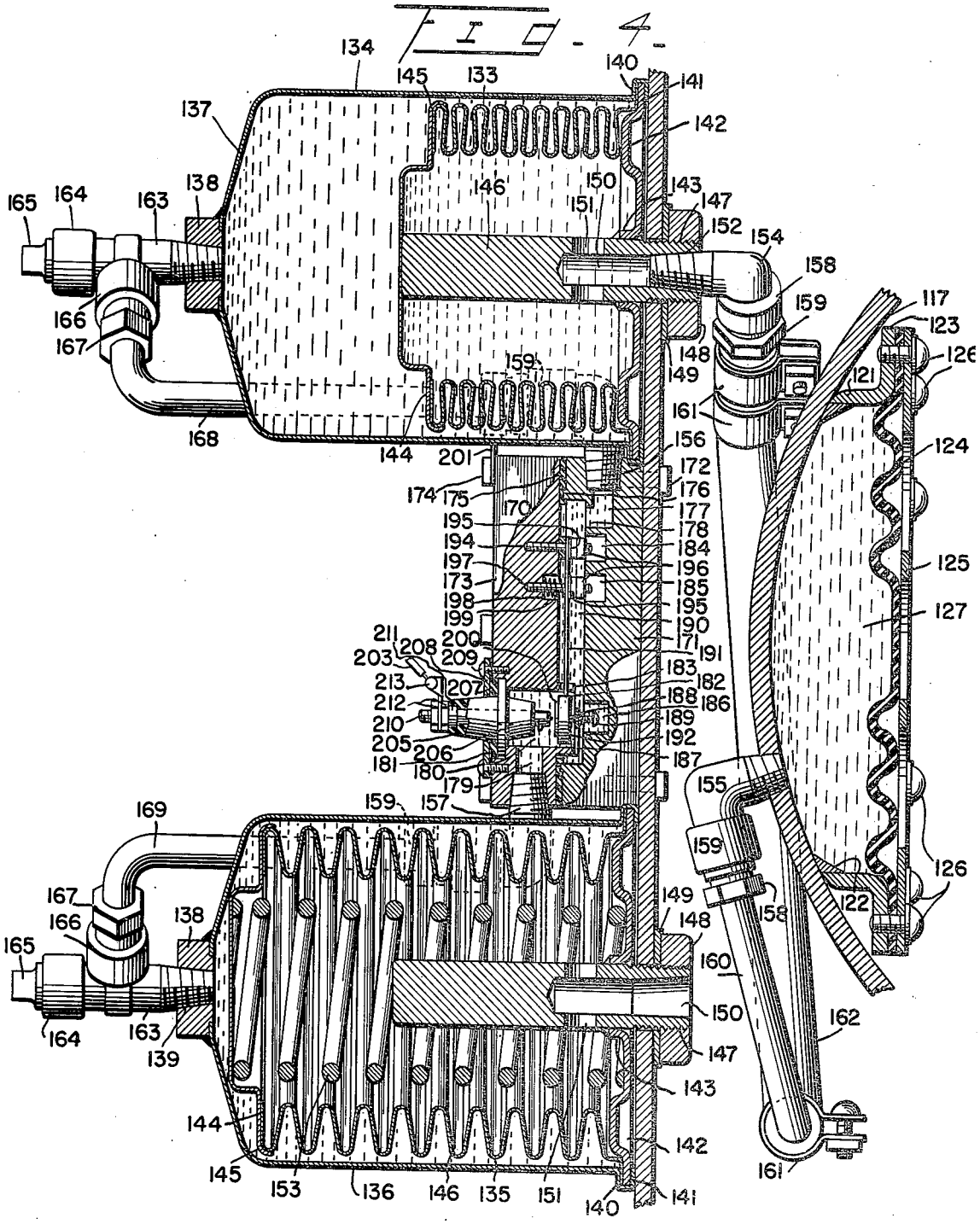
FIG. 4 is a view of the same apparatus as in FIG. 3 but on an enlarged scale, showing the pressure responsive sea facing chamber and the input and output or back volume bellows in section and the casing of the micro contact detector switch device broken away to show the details of this device.

As shown particularly in FIG. 4, the input bellows chamber 134 and the output or back volume bellows chamber 136 are each of generally cylindrical shape and have frusto-conical tops 137. Plugs 138 are mounted centrally of the frusto-conical tops 137 in suitable apertures therein and are secured to the tops again as by brazing, soldering, welding, or the like. These plugs each have central threaded holes 139 therein for receiving fittings 163. At its bottom each chamber 134 or 136 has an outwardly extending circumferential rim or flange 140 which is double crimped to engage a bottom plate 141 on both sides of the latter. Both bottom plate members 141 rest on the supporting plate 132 and each bottom plate member has an annular ridge 142 therein, for obvious reinforcement purposes, and a central aperture bounded by an upturned lip 143. The input bellows 133 and the output or back volume bellows 135 are each surmounted by hat-shaped top members 144 which members each have a downturned circumferential rim 145 secured to the bellows 133 and 135, in any suitable manner as by brazing, soldering, welding, or the like. The bottom edges of the bellows 133 and 135 are bent radially outwardly and are gripped between the top walls of the double rims 140 on the chambers 134 and 136, respectively, and the bottom plate members 141. Cylindrical members 146 are positioned centrally of the bellows 133 and 135 and these members perform triple functions, as a securing means for the bellows 133 and the chamber 134, and for the bellows 135 and the chamber 136 to the supporting plate 132, as a stop means for limiting the contraction of the bellows 133 and 135, and as the fluid inlet connection for the input bellows 133 and the air outlet connection for the output or back volume bellows 135. These cylindrical members 146 extend through the in-turned lips 143 on the bottom plate members 141, wherein they have a force fit, and each cylindrical member has its lower end externally threaded at 147 and extends through a suitable hole in the supporting plate 132. Nuts 148 and washers 149 engage the lower threaded ends of the cylindrical members 146 to secure the bellows and chamber units 133–134 and 135–136 to the supporting plate 132. Also, the cylindrical members 146 extend upwardly for slightly more than half the height of the chambers 134 and 136 so as to be abutted by the hat-shaped top members 144 and thereby limit contraction of the bellows 133 and 135.

In addition, the cylindrical members 146 are provided with axial bores 150, extending from the lower ends for approximately one third of the length, which bores at their tops intersect diametrically disposed bores 151, the two bores in each case providing communication with the interior of the respective bellows 133 and 135. The input bellows 133 is liquid filled, as will be later described, whereas the output or back volume bellows 135 is open through the connecting bores 151 and 150 in the cylindrical member 146 to the interior of the rear section 11 of the mine casing. A back volume spring 153 is interposed between the bottom plate member 141 and the hat-shaped top member 144 of the output or back volume bellows 135 and constitutes a biasing means to constrain the bellows toward fully extended position; no such biasing means is required in the input bellows 133 as the function is there performed by the entrained liquid.

The axial bore 150 in the cylindrical member 146 for the input bellows 133 is threaded internally at 152 and a street ell 154 having an enlarged boss 158 and a packing gland nut 159 is fitted into this bore. A flexible fluid connection is provided between the street ell 154 and the identical street ell 155 positioned in the opening in the bottom of the bowl shaped element 117. This connection consists of a piece of metal tubing 160 which at one end is secured in the street ell 155 by the packing gland nut 159 thereon and at the other end is secured into a piece of flexible tubing 162, rubber or the like, to which it is secured by a hose clamp 161; the connection between the flexible tubing 162 and the street ell 154 in the axial bore 150 of the cylindrical member 146 is formed by a similar but shorter piece of metal tubing (not shown) which is secured in the street ell 154 by the packing gland nut 159 thereon and in the flexible tubing 162 by double hose clamps 161.

As previously stated, the sea facing chamber 127 is formed by the bottom of the bowl shaped element 117, the diaphragm supporting cylinder 121, and the diaphragm 124. The primary liquid coupling system is comprised by the sea facing chamber 127 and the input bellows 133, together with the interconnecting fluid conduit sections 160 and 162. This system is filled with the primary coupling liquid, this being any liquid with suitable anti-freeze characteristics, for instance, a mixture of alcohol and water in the proportions commonly used in automobile radiators in the winter time.

Mounted in the plugs 138 in the tops of the chamber 134 for the input bellows 133 and the chamber 136 for the output or back volume bellows 135 there are "T" fittings 163 having threaded bottoms fitted into the central bores 139 in the plugs, enlarged top bosses 164, and similarly enlarged branch bosses 166. Closure plugs 165 are mounted in threaded relationship in the top bosses 164 and packing gland nuts 167 are likewise secured in threaded relationship in the branch bosses 166. The closure plugs 165 obviously can be removed to fill initially the chambers 134 and 136 or to replace any liquid that may evaporate or leak therefrom. A conduit section 168 is secured by the packing gland nut 167 in the branch boss 166 of the "T" fitting 163 on the chamber 134 for the input bellows 133 and this conduit section extends to the micro contact switch device 170, to be later described; similarly, a conduit section 169 is secured by the packing gland nut 167 in the branch boss 166 of the "T" fitting 163 on the chamber 136 for the output or back volume bellows 135 and this conduit section likewise extends to the micro contact switch device 170.

The micro contact switch device, generally designated by the reference numeral 170, is mounted on the supporting plate 132 intermediate the chambers 134 and 136 for the input bellows 133 and the output or back volume bellows 135, respectively, as is shown in FIG. 4. This device consists of a lower block 171, secured to the supporting plate 132 by suitable screws 172, and an upper block 173, secured to the lower block 171 by suitable screws 174. A gasket 175 of suitable material, for instance Neoprene, is positioned between the upper and lower blocks 171 and 173. The lower block 171 has an annular rib 176 thereon which is adapted to embed itself in the gasket 175 to effect sealing of the joint between the upper and lower blocks. Extending transversely from the right end (FIG. 4) there is formed in the lower block 151 a short passage 177 which terminates at its inner end in a short vertical passage 178. The outer end of the passage 177 is suitably threaded and a street ell 156 is fitted therein. The conduit section 168 from the chamber 134 for the input bellows 133 is secured in the street ell 156 by the usual packing gland nut 159. Similarly, extending transversely from the left end, FIG. 4, there is formed in the upper block 173 a complementary short passage 179 which terminates at its inner end in a vertical well 180. The outer end of the passage 179 also is suitably threaded and a street ell 157 is fitted therein. The conduit section 169 from the chamber 136 for the output or back volume bellows 135 is likewise secured in the street ell 157 by the usual packing gland nut 159. The well 180 is open at its bottom, the bottom being formed by an annular rib 182 on the under face of the upper block 173. The lower block 171 has a transverse channel 190 formed therein which communicates at its right end, FIG. 4, with the short vertical passage 178 in the lower block 171 and at its left end with the well 180 in the upper block 173.

The hydraulic channel comprised by the chamber 134 for the input bellows 133, "T" fitting 163, conduit section 168, street ell 156, passages 177 and 178, and the transverse channel 190 in the lower block 171, well 180 and passage 179 in the upper block 173, street ell 157, conduit section 169, "T" fitting 163, and chamber 136 for the output or back volume bellows 135 is filled with the secondary coupling liquid. The liquid perferably used is 360-cst Dow Corning fluid, a silicon base oil of high density and with a lower temperature coefficient of viscosity than any of the carbon base oils.

The movable switch element consists of a float 192 of a rubber composition mounted on a float spring 191. The rubber composition known commercially as Rubbertex has been found to be a satisfactory composition for the float 192. The float spring 191 is preferably made of phosphor bronze alloy 0.005" thick. The outer end of the float spring is offset at 193, FIGS. 4A, 4B, and 4C, and the offset portion is embedded in the float with its upper face flush with the upper face of the float. A platinum iridium contact disc 200 is soldered to the upper face of the offset portion 193 of the prong and cemented to the upper face of the float 192. The float 192 is of slightly less diameter than the well 180 and is positioned in and adjacent the bottom of the well. Adjacent its inner end the float spring 191 is provided with a hole through which a mounting stud 194 passes, this stud being mounted in a threaded hole in the under face of the upper block 173. Washers 195 are positioned on the stud 194 on either side of the float spring 191 and a nut 196 on the lower end of the stud. The lower block 171 is provided with a first bore 184 concentrically positioned with respect to the stud 194, so as to provide clearance for the stud, the washers 195, and the nut 196. A second stud 197 is spaced inwardly from the first stud 194 and passes freely through a hole in the float spring 191 forming a stop to limit downward movement of the latter. The stud 197 is likewise mounted in a threaded hole in the under face of the upper block 173 and a counterbore 198 provides space for a loading spring 199 which surrounds the stud. The loading spring 179 in part determines the period of oscillation of the float spring 191 and the float 192. A washer 195 and a nut 196 are again provided on the lower end of the stud 197 and likewise the lower block 171 is provided with a second bore 185 which similarly provides clearance for the stud 197 and washer 195 and the nut 196 thereon. The annular rib 182, which forms the bottom of the well 180 in the lower block 173, has a radial slot 183 therein which provides clearance to permit oscillation of the float spring 191.

A backstop is provided to limit downward movement of the float 192 and this backstop consists principally of a "U" shaped member 187 of slightly greater overall length than the radius of the well 180 in the upper block 173. The prongs of the "U" shaped member 187 are attached at their outer ends, as by spot welding, to the annular rib 182 on the under face of the upper block 173, which rib forms the bottom of the well 180. A set screw 189 is mounted in a suitably threaded hole in the body of the "U" shaped member 187 and is positioned axially of the well 180, a lock nut 188 being provided on the set screw 189 to maintain same in fixed position. A third bore 186 is provided in the lower block 171, concentrically of the well 180 in the upper block 173, and this bore provides clearance for the "U" shaped member 187 and the set screw 189.

The connection of the micro contact detector switch device 170 in the arming and firing circuit is made in part by a contact clip 201 mounted under one of the screws 174 which secures the upper block 173 to the lower block 171, the contact clip being preferably positioned under one of the screws in close juxtaposition to the mounting stud 194 for the switch prong 191 so as to make the part of the circuit through the upper block 173 of minimum length. A cable 204, FIG. 1, extends from the auxiliary terminal strip 109 on the interior of the compartment 110, a conductor 204 from this cable being connected to the contact clip 201.

For the fixed contact of the micro contact detector switch device 170 an element which is known commercially as a Stupakoff insulator has been successfully employed. This element comprises essentially a body 205 made of any of the well known phenolic condensation products and shaped as two integral cone frustums in base to base relationship, with an integral circumferential flange 206 at their plane of juncture. This flange is positioned in a circular recess 181 in the face of the upper block 173, which recess is formed as a counterbore of the well 180. A gasket washer 207 of suitable material, for instance Neoprene, is positioned around the body 205 and over the flange 206. An apertured retaining plate 208 is mounted over the gasket washer 207 with the body 205 projecting upwardly therethrough and this plate is secured to the upper block 173 by screws 209 mounted in suitable threaded holes in the block.

A central rod 210 is mounted freely in an axial bore extending through the body 205 of the insulator. This rod is threaded at its upper end and is adjustable axially of the body 205 by an adjusting nut 211 which is mounted in a counterbore in the top of the body. The lower end of the rod is diametrically slotted at 214, FIGS. 4A, 4B, and 4C, and the bottom of this rod forms a stop 217 to limit movement of the float 192 in the upward direction. A wiping contact spring 215 is suitably secured to the top of the slot 214 as by soldering at 216. The wiping contact spring 215 is formed as a generally one-half "V" shaped element, one leg of the half "V" being mounted horizontally by the soldering 216 at the top of the slot 214 and the other leg being inclined downwardly thereto and extending to the axis of the central rod 210, and thence being bent vertically downwardly so as normally to extend coincidentally with the axis of the rod. This wiping contact spring is preferably made of platinum-iridium alloy 0.005" diameter.

Figure 3:
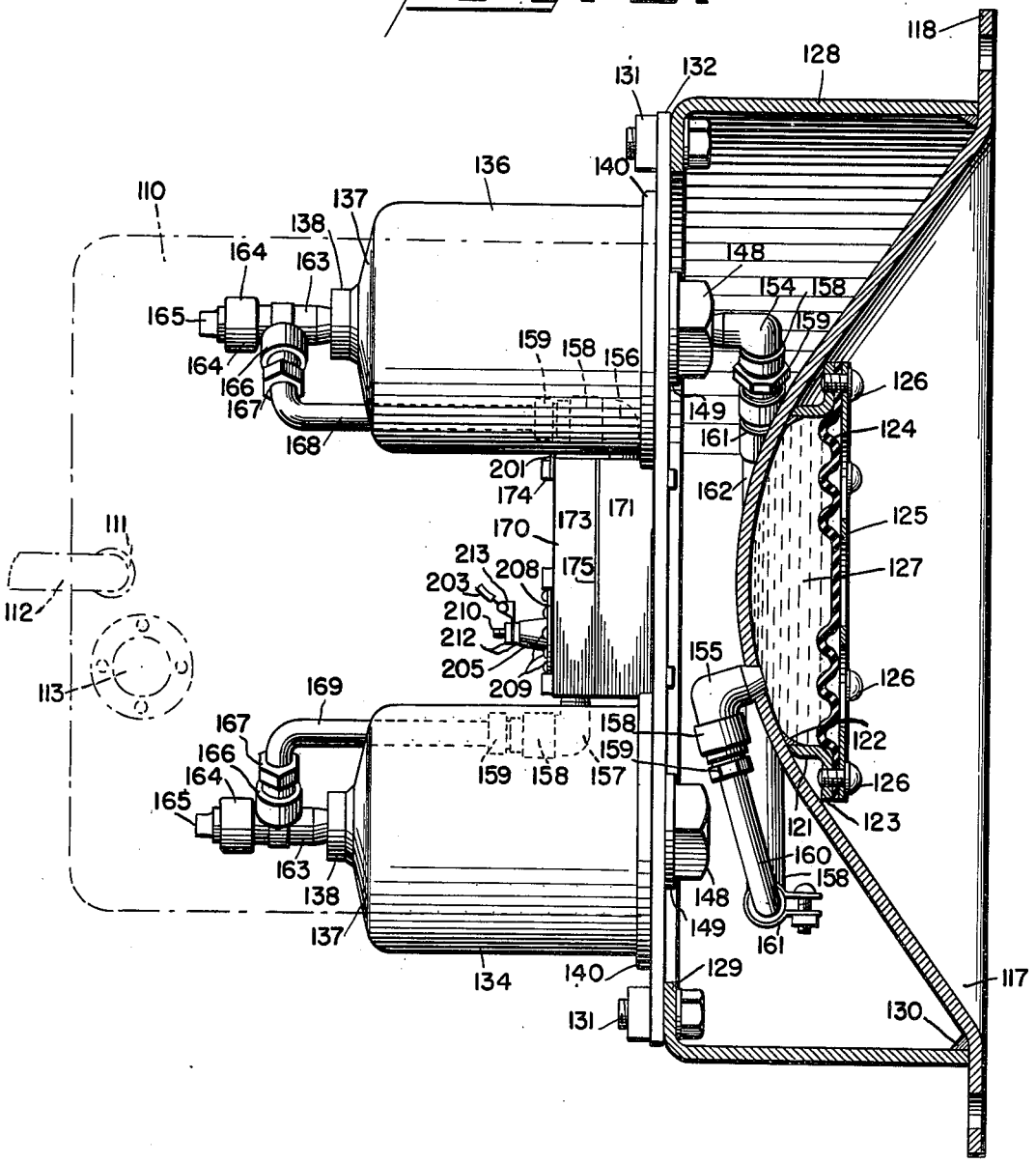
FIG. 3 is a view taken on the section line 3—3 of FIG. 1 showing the pressure responsive sea facing chamber and the serially connected input bellows and output or back volume bellows with the hydraulically operated micro contact detector switch device mounted and connected between the two bellows.

The connection of the micro contact switch device 170 in the arming and firing circuit is completed through a contact clip 213, FIG. 3, which is mounted on the upper threaded end of the central rod 210 intermediate a pair of nuts 212 on this rod in base to base relationship. A line 203 extends from the cable 204 to the contact clip 213.

Figures 4A, 4B, 4C:
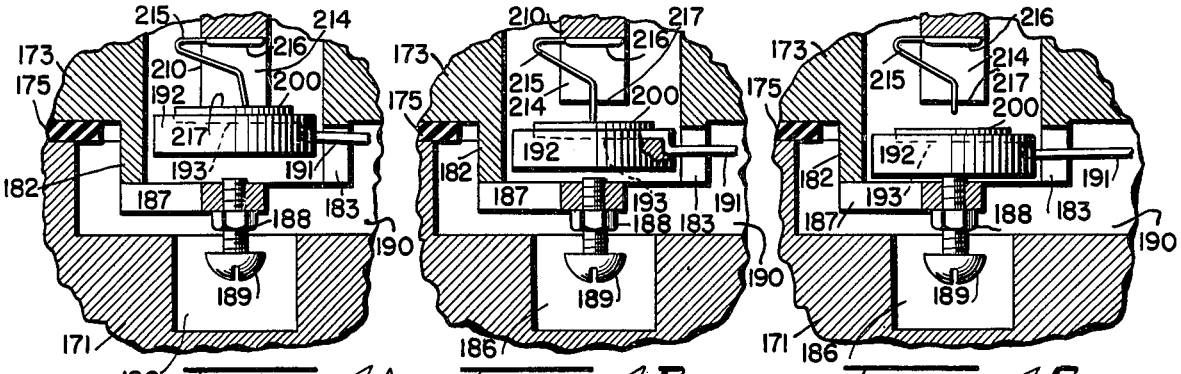
FIG. 4A is a detail view of the micro contact detector switch device of FIG. 4, showing the switch float in uppermost position, this being one of the closed circuit positions.
FIG. 4B is a view similar to FIG. 4A showing the switch float in neutral position between the upper and lower backstops.
FIG. 4C is also a view similar to FIG. 4A showing the switch float in lowermost position against the lower backstop.

FIG. 4A shows the float 192 in its uppermost position with the contact disc 200 carried thereby abutting the stop 217 on the central rod 210 and the free leg of the half "V" shaped wiping contact spring 215 compressed toward the fixed leg and the vertical extension of the free leg forced outwardly from its normal position axially of the central rod; FIG. 4B shows the float 192 in normal position and the wiping contact spring 215 in extended position with its vertical extension coincident with the axis of the central rod 190 and in contact with the disc 200 carried by the float; and FIG. 4C shows the float 192 in its lowermost position against the set screw 189 on the back stop 187, the vertical extension of the wiping contact spring 215 being separated from the contact disc 200 carried by the float. The wiping action of the contact spring 215 on the contact disc 200 tends to break up any film, such as some silicon compound which might be precipitated from the Dow Corning secondary coupling liquid by arc action, on the contact tip and disc and which might result in erratic behavior of the micro contact detector switch device.

The arming and firing circuits are shown in FIG. 5. As previously stated, the components of these circuits, capacitors, resistors, and relays, are enclosed by the compartment 110 and connected to the auxiliary terminal strip 109 on the interior of one of the walls of this compartment, with the exception of the clock 25, detonator 82, induction or pick-up coil 88, battery BA, and the sensitive detecting relay D, these being mounted elsewhere in the main casing section 1, as described above, and connected in the circuit through the cables 46, 100, 103–104, and 105, respectively, and main terminal strip 114 and cable 112. As also previously stated, the battery BA is a twelve volt unit, preferable consisting of two units of four No. 6 dry cells each in series. Conductor 104 is connected to the positive terminal and conductor 103 to the negative terminal of the battery BA. A circuit comprising contacts 200–215 of the micro contact detector switch device 170, a resistor R1, and a capacitor C1, connected in series by conductor 218, is shunted across the conductors 103 and 104. For the resistor R1 and the capacitor C1 values of 4,000 ohms and 3,700 mfd., respectively, have been found satisfactory. Thus it will be seen that, as long as the contacts 200 and 215 are kept closed, this being their normal condition, the capacitor C1 will be in the fully charged state. The contacts 200 and 215 are adapted to be opened by pressure impulses produced by passing vessels and impinging upon the diaphragm 124, but may also be opened momentarily by pressure impulses produced by waves.

A control circuit comprises a conductor 219 with a resistor R2 therein connected at one end to the conductor 218, intermediate the resistor R1 and the capacitor C1, and at the other end to the movable contact of a potentiometer or voltage divider R3; this movable contact is adjustable from the exterior of the compartment 110 by the knob 113, as previously described. A tail or feed back circuit is comprised by a conductor 220 with a resistor R4 therein, this conductor being connected at one end to the potentiometer or voltage divider R3 and at the other end to the conductor 103. For the resistor R2 a value of 40,000 ohms, the potentiometer or voltage divider R3 a value of 10,000 ohms, and the resistor R4 a value of 4,000 ohms have been found satisfactory. The control circuit further includes a conductor 221, connected to the other end of the potentiometer or voltage divider R3, the operating winding of control relay CR, conductor 222, and resistor R5 therein, the conductor 222 terminating at and being connected to the conductor 103. The control relay CR is energized and held operated by a current of 100 micro amperes as the contacts of the micro contact switch 170 are opened, the discharge current from the condenser C1 flowing through the winding of relay CR, at the expiration of ten seconds will have decreased sufficiently for relay CR to release and close the contacts 223 thereof. The current through the operating winding of the relay CR, and consequently the time delay period of the relay, may be varied by adjusting the movable contact of the potentiometer or voltage divider R3 through the knob 113.

The release of the control relay CR closes one side of the arming circuit for the detonator 82. This part circuit comprises the conductor 225, which is connected to the conductor 104, and one of the sets A of the contacts of the clock 25, the conductor 226, which is connected to the other contact of the A set of contacts of the clock 25, and the armature 224 of the control relay CR, the contact 223 of this relay, the conductor 227, and the conductor 228 which is connected to the conductor 227 and the detonator 82.

When the control relay CR has been released to closed circuit position, it is desired that it remain in such position for at least sixty seconds. A holding circuit is provided for holding the relay in this position for such period of time. The principal component of this circuit is a holding relay HR, this relay having an operating winding with approximately 3,750 ohms resistance and adapted to hold for sixty seconds when the discharge current from capacitor C2 will have decreased sufficiently for the relay to release. The operating circuit of this relay comprises conductor 225, which, as stated, is connected to conductor 104, contacts A of clock 25, conductor 226, armature 224 and contact 223 of control relay CR, conductor 227, (this part of the circuit being described above as also part of the arming circuit for the detonator 82) and the operating winding of the holding relay HR, conductor 232, the conductor 232 having resistor R6 and capacitor C2 in series therein and being connected to the conductor 104. For the resistor R6 and capacitor C2, values of approximately 3,500 ohms and 4,000 mfd's. respectively, have been found satisfactory. The holding circuit itself comprises conductor 234, connected to conductor 221 and forward contact 229 of the holding relay HR, armature 230 of this relay, and conductor 235, the conductor 235 having the resistor R7 therein and terminating at and being connected to the conductor 103. For the resistor R7 a value of approximately 100 ohms, the same as for resistor R5, has been found satisfactory. It will be noted that the holding circuit shunts the operating winding of the control relay CR, from conductor 221 to conductor 103. The capacitor C2 is maintained in normally fully charged state, the charging circuit comprising conductor 232, which is connected to conductor 104, the capacitor, conductor 233, back contact 231 and armature 230 of holding relay HR, conductor 235 and resistor R7, and the conductor 103.

A third relay also is provided, the firing relay FR. This relay is identical with the holding relay HR, that is, it has an operating winding with approximately 3,750 ohms resistance adapted to hold for sixty seconds when the discharge current from capacitor C3 will have decreased to a predetermined value corresponding to drop-out value of current for the relay.

The other side of the arming circuit for the detonator 82 is comprised by conductor 236, the third set of contacts C of the clock 25, conductor 237, and the make contact 247 and armature 248 of the firing relay FR, the conductor 103 from the negative terminal of the battery BA terminating at and being connected to the armature 248.

The principal component of the firing circuit is the sensitive detecting relay D. A device known commercially as the Sensitrol relay has been successfully employed for the instant purpose. This relay has an armature 240 which is adapted to oscillate and to close on either of two arcuately spaced contacts 241 or 243. This arrangement of the armature 240 for oscillatory movement and the provision of the double contacts 241 and 243 is desirable because the magnetic signature of a vessel is comprised by two or more parts of opposite polarities and it is desirable that the detecting relay be responsive to the entire range of the magnetic signature of the vessel. A double pronged permanent magnet 242 is provided for holding the armature 240 firmly against either contact 241 or 243 once the armature has been moved into engagement with such contact. In the actual device the permanent magnet 242 may, if desired, not be used but the contacts 241 and 243 may instead be magnetic elements. An operating winding DO is provided and this winding is connected by conductors 238 and 239 to the induction or magnetic pick up coil 88, these conductors being carried by the cable 100, as previously described. A resetting winding DR is also provided and this resetting winding is adapted to reset the armature 240 in the neutral or center position intermediate the pair of contacts 241 and 243.

This relay D is a sensitive relay adapted to be operated in response to the electromotive force generated within the pick up coil 88 by reason of the current flowing through the winding DO thereof. The armature or tongue 240 is preferably adapted to remain in any position in which it has been set and it may be assumed, for the purpose of description, that this armature has been moved into engagement with one of the contacts associated therewith as a result of the handling, transportation or planting of the mine. The manner in which the moving element or armature 240 of the relay D is restored to an initial position intermediate the contacts of the relay is as follows: Current for recharging the capacitor C3, the function of which is to be later described, flows through the resetting winding and this winding operates a plunger and linkage mechanism (not shown) so as to reset the armature 240 on the neutral or center position from the circuit making position against either contact 241 or 243, although the current through the resetting winding flows in only one direction.

The firing control circuit comprises a capacitor C3, conductor 250, armature 240 of detecting relay D, either contacts 241 and conductor 245 or contact 243 and conductors 244 and 245, second set of contacts B of the clock 25, conductor 246, resistor R8, operating winding of firing relay FR, conductor 251, and conductor 250. For the resistor R8 a value of 3,500 ohms has been found satisfactory, C3 should have the same value as the capacitor C2, that is, approximately 4,000 mfd's.

The charging circuit for the capacitor C3 comprises conductor 104, resetting winding DR of the detecting relay D, conductor 252, the capacitor, conductor 250, back contact 249 and armature 248 of the firing relay FR, and conductor 103 to battery BA.

The operation of the apparatus and circuits will now be described. Let it be assumed, by way of example, that the mine is planted in the water in one of the usual ways either by dropping from an aircraft or by lowering from a mine laying vessel. For the former case, the firing apparatus is designed to withstand deceleration resulting from dropping from the aircraft at a considerable height. Furthermore, if the mine should become buried in the mud, it would operate almost as effectively as on the hard bottom. Also, the firing apparatus will operate at various planting depths. After the mine has been planted in the water for two or three hours the soluble washer (not shown) under the releasing plunger 32 of the clock 25 will become dissolved and the clock will then start in operation. The cam 39 of the clock, FIG. 5, will be rotated in the clockwise direction with respect to the plate 38, the slot 44 in the cam moving along pin 45 on the plate 38. The contacts A will be closed first by the lobe 41 on the cam 39, the contacts B next on the lobe 42, and the contacts C by the lobe 43. Similarly the water soluble washer (also not shown) around the plunger 64 of the hydrostat device 50 will become dissolved and the pressure of the sea water operating on the diaphragm 65 will project the plunger inwardly, which motion will be amplified by the lazy tongs 71 to move the detonator 82 into the booster charge 55. The two or three hour period before the hydrostat device 50 is released to project the detonator 82 into the booster charge 55, is necessary in order to allow the mine laying vessel to move to a safe position in the case where the mine is laid from a vessel.

After the mine has been planted in the water for some time, fluid equilibrium will be established between the primary fluid system and the hydraulic channel. The apertured plate 125 protects the diaphragm 124 against contact with mud and marine growths over a large area of the diaphragm. Also, the relatively large area of the diaphragm permits pressure variations to be transmitted through viscuous mud with only slight attenuation. The increased pressure of the sea water due to the depth will force the diaphragm inwardly. As the diaphragm is flexed inwardly, some of the alcohol-water mixture in the sea facing chamber 127 will be forced through the conduit sections 160 and 162 and into the input bellows 133, thereby causing this bellows to expand. The expansion of the input bellows 133 will force an equivalent amount of the Dow Corning secondary coupling liquid through the conduit section 168, transverse channel 190 in the micro contact switch device 170, conduit section 169 and into the chamber 136 for the output or back volume bellows 135, thereby compressing this bellows against the resistance offered by the back volume spring 133 and forcing air from the bellows 135 through the bores 151 and 150 in the cylindrical member 146 and into the rear section 11 of the mine casing. After fluid equilibrium has been established between the primary fluid system, comprising the sea facing chamber 127 and the input bellows 133, and the hydraulic channel, the apparatus is in condition to be actuated by the pressure changes in the water due to a moving vessel.

The coupling arrangement described above has been found to be more desirable than that of having a pressure responsive bellows, such as a bellows similar to the input bellows 133, directly exposed to the pressure of the sea water since airplane planting, explosion shocks, and rough handling might cause damage to an exposed bellows.

As is well known, the pressure signature of a vessel varies directly with the square of the velocity up to the velocity where the effect of the vessel's waves is appreciable, that is up to the point where the vessel's waves have a wave length approximating the length of the vessel. FIG. 6 shows a typical keel profile of an approximately 7,000 ton freighter at a speed of fourteen knots in forty feet of water. It will be seen from this figure that the hydrostatic pressure is negative at a given point for a period of approximately fifteen seconds while the vessel is passing over that point. A study of waves in both the Atlantic and Pacific Oceans has shown that even during severs storms very few waves have a half period greater than ten seconds; stated otherwise, waves that will cause a 0.3 inch pressure change lasting from ten seconds or longer occur only about five percent of the time. Thus it will appear that, with the utilization of the proper time delay in the firing circuit, wave actuation of the arming apparatus will occur rarely, and in cases where the arming apparatus is actuated by wave action, the mine will not be fired for the reason that the magnetic conditions necessary for firing are not present.

In the case of moving vessels however, under most circumstances nearly all vessels, other than very small craft, create a pressure signature of sufficient duration to actuate the apparatus if there is sufficient amplitude to the pressure signal; that is, the contacts of the micro contact switch will be kept open for more than ten seconds. Such vessels, as is well known, also possess a magnetic field thereabout which causes magnetic variations at a fixed point of reference as the vessel moves past the reference point, such variations being defined herein as the magnetic signature of the vessel. It should be noted, moreover, that when the pressure actuated arming apparatus is used in combination with another apparatus for firing which is not influenced by wave action, such as the magnetic pick up 88 previously described, the time delay period may be reduced to approximately ten seconds since occasional actuation of the pressure responsive arming apparatus by waves will not cause the mine to be fired as the other apparatus will not be actuated. Furthermore the magnetic pick up performs an additional function in that it will prevent firing of the mine by a vessel at too great a distance athwartship. Let it be further assumed, in the instant example, that a signal from the pressure signature is received by the pressure responsive apparatus before the magnetic signature is detected by the pick up coil.

Referring now in particular to the micro contact detector switch device 170, this device performs the function of a detector in that it is responsive to the negative part of a pressure wave where such part has a period of greater than ten seconds. The normal position of the neutral buoyant float 192 is as shown in FIGS. 4 and 4B, this position being intermediate the back stop 189 and the upper stop 217 formed by the lower end of the central rod 210 with the wiping contact spring 215 carried by the rod resting on the contact disc 200 mounted on the float. If now the fluid equilibrium existing between the primary fluid system, comprised by the sea facing chamber 127, the conduit sections 160 and 162 and the input bellows 133, and the hydraulic channel comprised by the input bellows 133, conduit section 168, transverse channel 190 in the micro contact detector switch device 170, conduit section 169, and the chamber 136 for the output or back volume bellows 135, is disturbed, as by the aforesaid vessel passing nearby and producing a pressure wave simulating that of FIG. 6, the neutral buoyant float 192 will be forced upwardly against the upper stop 217, the position shown in FIG. 4A, by the increased pressure, and thereafter will be forced downwardly against the back stop 189, the position shown in FIG. 4C, by the reduced pressure. As the vessel moves into proximity to the mine, the pressure exerted on the diaphragm 124 at first increases, as is shown by the portion of the curve anterior to the first maximum, or the ordinate designated Bow, in FIG. 6. As when the mine was first planted in the water, but to a greater degree, a portion of the primary coupling liquid will be forced from the sea facing chamber 127, through the conduit sections 160 and 162, and into the input bellows 133, thereby expanding this bellows. Again, an equivalent amount of the Dow Corning secondary coupling liquid will be forced from the chamber 134 for the input bellows 133 through the conduit section 168, transverse channel 190 in the micro contact detector switch device 170, conduit section 169, and into the chamber 136 for the output or back volume bellows 135, thereby compressing this bellows and the back volume spring 153 and driving air from the interior of this bellows. The flow of the secondary coupling liquid upwardly through the well 180 in the upper block 173 from the transverse channel 190 into the conduit section 169, will force the neutral buoyant float 192 from the neutral position, FIG. 4B, upwardly against the stop 217 comprised by the bottom of the central rod 210, the position shown in FIG. 4A. As the bow of the vessel passes over the mine, or in close athwartship proximity thereto, there will be a sharp reduction in the pressure on the diaphragm 124, as is shown by the portion of the curve between the first maximum and the first minimum in FIG. 6, and the flows of the liquids through both the hydraulic channel and the primary fluid system will be reversed. The back volume spring 153, aided by air under pressure from the rear section 11 of the mine casing entering through the bores 150 and 151 in the cylindrical member 146, will expand the output or back volume bellows 135. The expansion of this bellows will force an equivalent volume of the Dow Corning secondary coupling liquid from the chamber 136 for the output or back volume bellows 135, through the conduit section 169, the transverse channel 190 in the micro contact detector switch device 170, the conduit section 168, and into the chamber 134 for the input bellows 135, thereby compressing the latter bellows; an equivalent volume of the primary coupling liquid will be forced from the input bellows 133 and will pass through the conduit sections 162 and 160 and into the sea facing chamber 127. Conversely, the downward flow of the secondary coupling liquid through the well 180 in the upper block 173 of the micro contact detector switch device 170 will force the neutral buoyant float 192 away from the upper stop 217 on the lower end of the central rod 210, thereby separating the contact disc 200, carried by the float, from the wiping contact spring 215, mounted by the central rod 210, as the float passes downwardly through the neutral position of FIG. 4B, and to its lowermost position against the back stop 189, as shown in FIG. 4C.

In order to reduce the tidal biasing effect on the micro contact detector switch device 170, it is desirable that provision be made for tide filtering. This can be accomplished through the agency of a long time constant filter, the effect of which is determined by the fluid resistance around the float 192, this in turn being determined by the limited clearance between the float and the wall of the well 180, and by the diameter of the conduit section 168 between the chamber 134 for the input bellows 133 and the micro contact detector switch device 170, the cross sectional area of the transverse channel 190 in the micro contact detector switch device, the diameter of the conduit section 169 between the micro contact detector switch device and the chamber 136 for the output or back volume bellows 135, and the proper volume compliance of the latter bellows. The volume compliance of the bellows as employed herein is defined as the axial displacement per unit of applied force. The limited clearance between the float 192 and the wall of the well 180 increases the sensitivity of the micro contact switch device as a detector and further compensates for variations in the static pressure of the sea water, due to varying planting depths, by equalization of the pressure of the Dow Corning secondary coupling liquid on the opposite sides of the neutral buoyant float.

The period of travel of the neutral buoyant float 192 from the upper stop 217 on the lower end of the central rod 210 to its lowermost position against the back stop 189 is about fifteen seconds in the case of most vessels, with the exception of very small craft, as is shown by the curve of FIG. 6. Three different time constants enter into the movement of the float 192 as is shown by FIG. 7, this figure being a graph of the pressure differential across the float as a function of the duration of the pressure wave of FIG. 6. With the float in the neutral position of FIG. 4B and before the pressure wave from an approaching vessel has impinged on the diaphragm 124, the pressure differential across the float is zero. As this pressure differential builds up, such as on the section of the curve of FIG. 6 anterior to the first maximum, the contact pressure between the contact disc 200 and the wiping contact spring 215 carried by the central rod 210 is increased. The limit of movement of the float before it strikes the upper stop 217 on the lower end of the central rod is about 0.002 inch. Upon reaching the upper stop 217, the compliance of the float will drop to zero. The term compliance, as employed herein, is the amount of displacement per unit of applied force. The pressure differential across the float increases rapidly as a negative quantity on the section of the curve of FIG. 6 between the first maximum and the first minimum of the curve and the float is moved rapidly downwardly, overcoming the bias or static contact pressure between the contact disc 200 and the wiping contact spring 215, and comes to rest against the back stop 189. The limit of movement of the float between the neutral position of FIG. 4B and the lowermost position against the back stop 189, as shown in FIG. 4C, is about 0.01 inch.

After the float reaches the back stop 189, the pressure differential across same begins to decay exponentially with a time constant $T\gamma$ as shown at c in FIG. 7. When the pressure differential has decreased enough to allow the float to leave the back stop, the float will assume temporarily some position intermediate that of FIG. 4C and FIG. 4B; at this position of the float, the pressure differential continues to decrease with a time constant $T\alpha$, as shown at b in FIG. 7. Finally, when the float reaches the position of FIG. 4B and comes into contact with the wiping contact spring 215, the pressure differential decreases with a time constant $T\beta$ as shown at a in FIG. 7. From theoretical considerations it might be assumed that the contacts 200 and 215 would be separated at the point where the pressure curve of FIG. 6 crosses the horizontal axis, that is, adjacent the ordinate designated Bow, and would be closed at the point where this curve recrosses the horizontal axis, that is, adjacent the ordinate designated Stern; however in actual practice it has been found that, due to the various constants of the micro contact detector switch device 170, these contacts are opened and closed, respectively, somewhat in advance of these points, that is, at about the points designated x and y on this curve. The maximum increase in the negative pressure that is required to separate the contacts 200 and 215 is a measure of the initial sensitivity of the micro contact detector switch device as a fluid pressure detector and this factor is determined by the initial bias of the device, that is, the mass of the neutral buoyant float 192, contact disc 200, and supporting prong 191, and the moduli of elasticity of the supporting prong and the biasing spring 199.

The operation of the arming and firing circuits of FIG. 5 in the assumed example, is as follows: Normally the float 192 of the micro contact detector switch device 170 is in the neutral position of FIG. 4B with the wiping contact spring 215 carried by the central rod 210 resting on the contact disc 200 carried by the float 192. The battery BA keeps the capacitor C1 fully charged, the charging current flowing through the conductors 104 and 103, contacts 200 and 215 of the micro contact detector switch device, resistor R1, and conductor 218; the resistor R1 limiting this current. Current from the battery BA also flows through the conductor 104, contacts 200–215 of the micro contact detector switch device 170, resistor R1, conductor 218, conductor 219, resistor R2, potentiometer or voltage divider R3, conductor 221, operating winding of control relay CR, conductor 222, resistor R5, and conductor 103, this current holding the relay "pulled up", that is, with the armature 224 away from the contact 223. As this current flows throughout the active life of the mine, it must be quite small in order not to constitute too great a drain on the battery BA and the values of the resistors R1, R2, and R5 and the potentiometer or voltage divider R3 are so chosen that this current will be limited to a value just sufficient to hold the relay CR "pulled up", a current of 100 microamperes having been found to be sufficient for this purpose. Upon separation of the contacts 200 and 215, as by a negative pressure wave impinging upon the diaphragm 124, as previously stated, the capacitor C1 will discharge through conductor 218, conductor 219, resistor R2, potentiometer or voltage divider R3, conductor 221, operating winding of control relay CR, conductor 222, resistor R5, and conductor 103.

The control relay CR may be a commercial type of relay. With the predetermined impedance of the winding and the constants of the circuit, that is, the values of the capacitor C1, resistor R2, potentiometer or voltage divider R3, and resistor R5, as selected, the current flowing through the operating winding of relay CR will decay in ten seconds, after the contacts 200–215 of the micro contact detector switch device have been opened, so that at the end of this period the armature 224 will release and close against the contact 223. This period however may be varied within limits by the movable contact of the potentiometer or voltage divider R3 which, as previously stated, is adjustable by the knob 113. The setting of this knob will determine what fractional part of the discharge current from the capacitor C1 will flow through the operating winding of the control relay CR and what part will be shunted through the tail or feed back circuit comprised by the conductor 220 and the resistor R4. As this contact is moved toward the right, FIG. 5, the resistance in series with the operating winding of the control relay CR is increased, the current through this winding is correspondingly decreased, and the time delay period of the relay is lengthened; conversely, as the contact is moved toward the left, the resistance in series with the operating winding of the control relay CR is decreased, the current through this relay winding is correspondingly increased, and the time delay period of the relay is shortened. Should the contacts 200 and 215 of the micro contact detector switch device 170 be reclosed before the approximately ten second time delay period of the relay has elapsed, due to the pressure wave impinging on the diaphragm 124 being of less than ten seconds duration, the relay CR will not be released and the capacitor C1 will be reconnected across the terminals of the battery BA and the circuit will be recycled or restored to normal.

The capacitor C2 furnishes the electrical energy for maintaining the holding relay HR operated. This capacitor is normally kept charged from the battery BA through conductor 104, the capacitor, conductor 232, back contact 231 and armature 230 of the holding relay HR, conductor 235, resistor R7, and conductor 103 to the battery.

Operation of the control relay CR, due to the contacts 200 and 215 of the micro contact detector switch device being held open for longer than the predetermined ten second period, will cause the operating circuit for the holding relay HR to be completed. It is assumed that the clock 25 has been previously started in operation and that the cam 39 thereof has been rotated through a sufficient angular displacement such that the lobe 41 of this cam has closed the set of contacts A. The charging circuit for the capacitor C2 will now be broken due to the armature 230 being pulled away from the back contact 231 of the holding relay HR and this capacitor will discharge through conductor 104, conductor 225, contacts A in clock 25, conductor 226, armature 224 and contact 223 of control CR, conductor 227, the operating winding of holding relay HR, resistor R6, and conductor 232. The holding relay HR is preferably a commercial relay and the predetermined impedance of its operating winding, the constants of the circuit, that is, the values of the capacitor C2 and the resistor R6, are so selected that the current from the capacitor will decrease to the drop out value of the relay in approximately sixty (60) seconds. It therefore follows that once the control relay CR has been released to circuit closing position by a pressure wave of greater than ten seconds period impinging upon the diaphragm 124, the subsequent attenuation of such wave will not in any way affect the circuits beyond the control relay for a sixty second period immediately following the ten second period.

Operation of the control relay CR also arms the detonator 82, positive battery being put on the latter through conductor 104, armature 225, set of contacts A in the clock 25, armature 224 and contact 223 of the control relay, conductor 227, and conductor 228.

The capacitor C3 furnishes the electrical energy for operating the firing relay FR. This capacitor is normally kept fully charged by the battery BA through conductor 104, the resetting winding DR of the detecting relay D, conductor 252, the capacitor, conductor 250, back contact 249 and armature 248 of the firing relay FR, and conductor 103 to the battery.

Let is now be assumed that a vessel having a magnetic signature, comprising an elemental portion or characteristic of one polarity followed by an elemental portion or characteristic of the opposite polarity, moves within the vicinity of the mine or passes above the mine. As the first portion of the magnetic signature is projected into proximate relationship with respect to the induction or magnetic pick up coil 88, an electromotive force is generated within the coil and the resulting current will operate the sensitive detecting relay D and cause the armature 240 thereof to be moved into engagement with either the contact 241 or the contact 243, as the case may be. For the purpose of this description it may be assumed that the armature of the relay will be moved into engagement with the contact 241. Since, however, the contacts are connected by the conductors 244 and 245, the result would be no different if the armature would have been moved into engagement with the contact 243. It will be recalled that the clock 25 has been previously started in operation and that the cam 39 thereof has been rotated through a sufficient angular displacement such that the contacts B have been closed. The firing control circuit is now complete and the capacitor C3 will discharge through conductor 250, armature 240 of detecting relay D, contact 241, conductor 245, contacts B of clock 25, conductor 246, resistor R8, the winding of the firing relay FR, and conductor 251, thereby operating the firing relay.

The operation of the firing relay FR completes the circuit for the detonator 82. This relay is adapted to hold for sixty seconds when energized by the discharge of the capacitor C3, a period of time, it will be recalled, equal to the holding time of relay HR. It is further assumed that the clock 25 has been previously started in operation and that the cam 39 thereof has been rotated through a sufficient angular displacement that the set of contacts C has been closed. The other side of the circuit for the detonator 82 is from the detonator, through conductor 236, contacts C of the clock 25, conductor 237, make contact 247 and armature 248 of the firing relay FR, and conductor 103 to the battery BA. The detonator operates over the circuit just described thereby firing the mine under a vulnerable portion of the vessel.

From what has been previously described, it will be apparent that when the clock 25 is released for operation by the dissolution of the soluble washer (not shown) under the plunger 32, the cam 39 will be rotated through an angular displacement that is limited by the lost motion connection comprised by the pin 45 in the plate 38 and the slot 44 in the cam and that first the set of contacts A, then the set of contacts B, and finally the set of contacts C will be closed. As a matter of precaution, any contacts in the firing circuit for the detonator, such as the sets of contacts C, should be closed last.

If, as may happen prior to or during the planting of the mine, the armature 240 of relay D is moved to circuit closing position, the armature 240 will remain in circuit closing position until restored by the resetting magnet DR of the relay. The manner in which this is accomplished will now be described.

When a period of time has elapsed sufficient for contacts B of the clock 25 to be closed, capacitor C3 discharges through the winding of relay FR over a circuit including the closed contacts of relay D, contacts B of the arming clock, and the resistor R8. As armature 248 of relay FR moves away from contact 249, the winding of relay FR is disconnected from the negative terminal of battery BA and the relay is held operated for a period of sixty seconds by the discharge current from the capacitor C3 by reason of the provision of the resistor R8 within the discharge circuit of the capacitor. At the completion of this sixty second period, the discharge current from capacitor C3 is decreased sufficiently for relay FR to release. As armature 248 of relay FR moves into engagement with contact 249 a circuit is closed from the positive terminal of battery BA by way of conductor 104, winding DR of the resetting magnet of relay D, conductor 252, capacitor C3, conductor 250, contact 249, and armature 248 of relay FR, conductor 103, and thence to the negative terminal of battery BA, thereby quickly charging the condenser C3 and causing the resetting magnet DR to operate and restore the armature 240 of relay D to a position intermediate contacts 241 and 243 and disengaged therefrom. As capacitor C3 becomes substantially fully charged, the charging current thereof is reduced sufficiently for the resetting magnet DR to release and relay D, therefore, is now in a condition to respond to a signal received from the pick-up coil 88. As armature 240 of the sensitive relay D moves away from contact 241 or 243, as the case may be, the operating circuit to relay FR is interrupted, and the armature 248 of relay FR, therefore, remains continuously in engagement with back contact 249 thereby to maintain capacitor C3 fully charged until a signal has been received from the pick-up coil 88.

As heretofore described, the holding relay HR and the firing relay FR are identical relays, are energized by capacitors C2 and C3 respectively of the same value, and both relays hold for sixty seconds when once energized. If no magnetic signal should be received by the pick-up coil 88 during the sixty second holding period of these relays, they will both drop back to normal positions, relay HR with its armature 230 against the back contact 231 and relay FR with its armature 248 against the back contact 249. The capacitors C2 and C3 will now be recharged, the recharging current for the capacitor C2 flowing from the battery BA through conductor 104, conductor 232, the capacitor, conductor 233, back contact 231 and armature 230, conductor 235 and resistor R7, and conductor 103 to the battery; and the recharging current for the capacitor C3 flowing from the battery BA through the conductor 104, resetting winding DR of the detecting relay D, conductor 252, the capacitor, conductor 250, back contact 249 and armature 248, and conductor 103 to the battery, the resetting winding DR again setting the armature 240 of the detecting relay D on the center or intermediate position.

In the preceding description the micro contact detector switch device 170 and control relay CR and the circuits controlled thereby have been described as the arming apparatus and circuit and the induction or magnetic pick up coil 88 and relay FR and circuit controlled thereby have been described as the firing apparatus and circuit. However in actual operation, without any change in the apparatus or circuits, these functions may be reversed. It has been previously pointed out that the pressure signature of a vessel is dependent upon a number of factors, such as the shape of the hull, speed of the vessel, and depth of the water in which the vessel is traveling. Likewise the magnetic signature of a vessel is also an individual characteristic of the vessel, depending upon such factors as whether the vessel was constructed in the northern or southern hemisphere, the direction in which the keel was laid, shape of the hull and the arrangement of the magnetic masses supported thereby and the extent and effect of any means that might have been employed for degaussing the vessel. If it should be the case that a vessel might have a small pressure signature and a strong magnetic signature, the induction or magnetic pick up coil 88 and connected circuits, including the relay FR, would function as the arming means the the micro contact detector switch device 170 and connected circuits, including the relay HR, would function as the firing means. In this connection the previous description that the relays HR and FR are identical and are energized by capacitors C2 and C3, respectively, of the same rating, and that the relays hold for the same period of time when energized, should be recalled.

Let it now be assumed that the clock 25 has been previously started in operation and that the cam 39 thereof has been rotated through a sufficient angular displacement that the lobe 41 of this cam has closed the set of contacts A and the lobe 42 the set of contacts B. Assuming further that a magnetic signal from a moving vessel has been detected by the induction or magnetic pick up coil 88 and that relay CR has not yet operated in response to pressure signal received from the vessel by the micro contact detector switch device 170. In the assumed case, the armature 240 of the sensitive detecting relay D will either be moved against the contact 241 or the contact 243, depending upon what polarity of the magnetic signature has been detected, and the arming circuit for the detonator 82 will now be completed. The capacitor C3 discharges through the conductor 252, armature 240 of detecting relay D, either contact 241 and conductor 245 (or contact 243, conductor 244 and conductor 245, as the case may be) set of contacts B in the clock 25, conductor 246 and resistor R8, operating winding of relay FR, and conductor 251 thereby operating relay FR. The armature 248 of the relay FR thus will be pulled away from the back contact 249 and against the forward contact 247 and the relay will be held operated for sixty seconds, that is, until the current from the capacitor C3 has decreased to the drop out value of the relay. It is further assumed that the clock 25 has been previously started in operation and that the cam 39 thereof has been rotated through a sufficient angular displacement such that the set of contacts C has been closed. The detonator 82 is now armed, negative battery being placed thereon through conductor 103, armature 248 and make contact 247 of the firing relay FR, conductor 237, set of contacts C in the clock 25, and conductor 236 and remains armed for sixty seconds or until the mine explodes, whichever is the earlier.

As a signal portion of the pressure signature of the moving vessel is detected by the micro contact detector switch device 170, the contacts 200 and 215 of the latter will be disengaged thereby disconnecting the winding of relay CR from the positive terminal of battery BA and the capacitor C1 will discharge through conductors 218 and 219, resistor R2, voltage divider R3, conductor 221, the winding of relay CR, conductor 222 and resistor R5, and conductor 103. At the end of ten seconds the current from the capacitor C1 will have decreased to the drop-out value of relay CR and the relay will release, the armature 224 thereof closing on the contact 223. Since it has been previously assumed that both of the sets of contacts B and C in the clock 25 have been closed it necessarily follows that the set A has been closed. The firing circuit for the detonator 82 is now completed by the operation of relay CR, this circuit being traced from the positive terminal of battery BA, conductor 104, conductor 225, set of contacts A in the clock 25, conductor 226, armature 224 and contact 223 of the relay CR, and the conductors 227 and 228, the detonator 82, from which the circuit continues by way of conductor 236, clock contacts C, conductor 237, contact 247 and armature 248 of relay FR, conductor 103 and thence to the negative terminal of battery BA.

From the above it will be seen that there is here provided a mine which is armed and fired in response to two characteristics of a vessel in combination, the pressure signature and the magnetic signature, and it follows that such a mine cannot be swept by any means simulating either of these characteristics alone. There are numerous known methods of sweeping magnetic mines and in the use of any of these magnetic sweeping methods the detecting relay D might be operated and, in turn, the relay FR. However, unless some condition is also present that will operate the micro contact detector switch device 170 and maintain same operated for ten or more seconds, the mine will not be fired. Apart from waves, and as pointed out above, waves having periods of ten seconds or more are exceptionally rare, it appears that any method for sweeping the instant mine would necessarily have to involve a structure that would simulate a vessel hull and such device would obviously be expendible, that is, one such device would be destroyed for each mine swept.

In the event that an attempt is made to sweep the mine by a magnetic sweep without employing a pressure signal concurrently therewith, the operation of detecting relay D and relay FR in response to the magnetic signal detected by the pick-up coil 88 is without effect for the reason that the armature 224 of relay CR is not moved into engagement with contact 223 at this time.

If, on the other hand, an attempt is made to sweep the mine by a variation in the pressure of the water surrounding the mine and without employing a magnetic sweep, the actuation of relay CR to circuit closing position in response to the pressure signal received is without effect for the reason that the relay FR is unoperated. In either event, the arming and control circuits recycle or restore to normal after a predetermined period of time such, for example, as sixty seconds after the sweep signal has been received, regardless of whether the sweep signal is pressure or magnetic in character.

While there is shown and described herein a certain preferred embodiment of the invention, many other and varied forms and uses will present themselves to those versed in the art without departing from the spirit of the invention and the invention, therefore, is not limited either in structure or in use except as indicated by the terms and scope of the appended claims.

The invention herein described and claimed may be manufactured and used by or for the Government of the United States of America for governmental purposes without the payment of any royalties thereon or therefor.

What is claimed as new and desired to be secured by Letters Patent of the United States is:

1. In a pressure responsive mine having a casing and an arming and firing circuit therein, a pressure responsive device mounted in the casing and exposed to the pressure of the sea water, a second pressure responsive device mounted in the casing, a fluid connection between the first and second pressure responsive devices, a third pressure responsive device mounted in the casing, a restricted fluid pressure responsive connection between the second and third pressure responsive devices, and a circuit making and breaking device positioned in the restricted connection between the second and third pressure responsive devices and connected in the arming and firing circuit.

2. In a pressure responsive device having a casing and an arming and firing circuit therein, a pressure responsive device mounted in the casing and exposed to the pressure of the sea water, a second pressure responsive device mounted in the casing, a fluid connection between the two pressure responsive devices, a third pressure responsive device mounted in the casing and having a fluid chamber therein, the third pressure responsive device being spring loaded and having an air chamber in communication with the interior of the casing and said fluid chamber, a restricted connection between the second fluid pressure responsive device and said fluid chamber, and a fluid pressure responsive circuit making and breaking device positioned in the restricted connection and connected in the arming and firing circuit.

3. In a pressure responsive mine having a casing and an arming and firing circuit therein, a pressure responsive device mounted in the casing and exposed to the sea water, another pressure responsive device mounted in the casing, said latter pressure responsive device being spring loaded and having an air chamber in communication with the interior of the mine casing, a fluid pressure connection between the pressure responsive devices, a section of said fluid pressure condition being restricted, and a fluid pressure responsive circuit making and breaking device positioned in the restricted section and connected in the arming and firing circuit.

4. In a pressure responsive mine having a casing and an arming and firing circuit therein, a pressure responsive device mounted in the casing and exposed to the pressure of the surrounding water, said pressure responsive device having two chambers, a primary fluid in one chamber, a secondary fluid in the other chamber, another pressure responsive device mounted in the casing, said latter pressure responsive device also having two chambers, one of said last named chambers containing a loading spring and having an air connection with the interior of the mine casing, a restricted fluid connection between the secondary fluid chamber of the first pressure responsive device and the fluid chamber of said latter pressure responsive device, and a fluid pressure responsive circuit making and breaking device positioned in the restricted connection and connected in the arming and firing circuit.

5. In a pressure responsive mine having a casing and an arming and firing circuit therein, a pressure responsive device having a chamber and mounted in the casing and exposed to the pressure of the sea water, a second pressure responsive device mounted in the casing, said second pressure responsive device having a pair of chambers, a primary fluid transmitting system comprising the chamber of the first pressure responsive device and a chamber of the second pressure responsive device and a fluid connection between the two chambers, a third pressure responsive device mounted in the casing, said third pressure responsive device also having a pair of chambers, one chamber of the latter pressure responsive device containing a loading spring and having air communication with the interior of the mine casing, a secondary fluid transmitting system comprising the other chambers of the second and third pressure responsive devices, a restricted section in said secondary fluid transmitting system, and a fluid pressure responsive switch positioned in said restricted section and connected in said arming and firing circuit.

6. In a pressure responsive mine having a casing, a pressure responsive device mounted in said casing and exposed to the pressure of the sea water, a second pressure responsive device also mounted in said casing, a fluid connection between the two fluid pressure responsive devices, an arming circuit for said mine, a circuit making and breaking device in said arming circuit, and means responsive to the rate of flow of fluid through said fluid connection for actuating said switch when the rate of flow of said fluid exceeds a predetermined minimum.

7. In a pressure responsive mine having a casing, a pressure responsive device mounted in said casing and exposed to the pressure of the sea water, conduit means connected to the fluid pressure responsive device and through which the fluid pressure responsive device is adapted to cause fluid to flow in response to variations in the pressure of the sea water, a fluid pressure responsive circuit making and breaking device positioned in said conduit means, said circuit making and breaking device comprising an oscillatory member, said oscillatory member having limited clearance with the wall of said conduit means, an arming circuit for the mine comprising an electroresponsive detonator, the fluid pressure responsive circuit making and breaking device being connected in and controlling one side of the circuit of the detonator, a firing circuit comprising a magnetic pick-up, and means controlled by the magnetic pick-up for selectively closing the other side of the circuit of the detonator.

8. In a system for arming and firing a marine mine, conduit means through which fluid is adapted to flow, a fluid pressure responsive switch positioned in the conduit means, a source of electromotive force, a normally charged capacitor, said switch and capacitor being connected in series across the source of electromotive force, a detonator, an arming circuit for connecting said detonator to said source of electromotive force and constructed and arranged to be operated by energy discharged from the capacitor when the switch is operated, a second capacitor shunted across said source of electromotive force, and a firing circuit for connecting said detonator to the other side of said source of electromotive force and adapted to be energized by said second capacitor.

9. In a system for arming and firing a marine mine, conduit means through which liquid is adapted to flow, a normally closed fluid pressure responsive switch positioned in the conduit means, a source of electromotive force, a capacitor, said switch and capacitor being connected in series across the source of said electromotive force, a detonator, an arming circuit for connecting said detonator to said source of electromotive force and constructed and arranged to be operated by energy discharged from the capacitor when the switch is opened, a second capacitor shunted across said source of electromotive force, a firing circuit for connecting said detonator to the other side of said source of electromotive force and adapted to be energized by said second capacitor, a magnetic pick-up, and circuit making and breaking means connected to said magnetic pick-up and in said firing circuit for controlling the firing circuit.

10. In a system for arming and firing a marine mine, conduit means through which fluid is adapted to flow, a fluid pressure responsive switch positioned in the conduit means, a source of electromotive force, a capacitor, said switch and capacitor being connected in series across the source of electromotive force, a detonator, an arming circuit including the detonator and shunted across the source of electromotive force, a relay connected across the capacitor and having means for controlling the opening and closing of said circuit, a second capacitor normally connected across the source of electromotive force, a holding circuit for said relay and including said circuit controlling means, and a second relay shunted across said second capacitor having means for controlling said holding circuit.

11. In a system for arming and firing a marine mine, conduit means through which fluid is adapted to flow, a fluid pressure responsive switch positioned in the conduit means, a source of electromotive force, a capacitor, said switch and capacitor being connected across the source of electromotive force, a timing device having a set of closed contacts, a control circuit shunted across said capacitor, a relay included in said control circuit and operable in response to a current variation therein, a detonator, an arming circuit for connecting said detonator to said source of electromotive force, said arming circuit including said detonator and the contacts of both said timing device and said relay.

12. In a system for arming and firing a marine mine, conduit means through which fluid is adapted to flow, a fluid pressure responsive switch positioned in the conduit means, a source of electromotive force, a capacitor, said switch and capacitor being connected across the source of electromotive force, a timing device having a plurality of pairs of closed contacts, a control circuit connected across said capacitor, a relay in said control circuit and operable in response to a current variation therein, a second relay, a detonator, an arming circuit for operatively connecting the detonator to the source of electromotive force, said plurality of pairs of contacts of the timing device, and the contacts of both of said relays, an additional pair of closed contacts on said timing device, and a firing control circuit including said additional pair of contacts and the winding of said second relay.

13. In a system for arming and firing a marine mine, conduit means through which fluid is adapted to flow, a fluid pressure responsive switch positioned in the conduit means, a source of electromotive force, a capacitor, said switch and capacitor being connected across the source of electromotive force, a timing device having a plurality of pairs of contacts, a control circuit connected across said capacitor, a relay in said control circuit and operable in response to a current variation therein, a second relay, a detonator, an arming circuit for establishing an operative electrical connection between the detonator and the source of electromotive force, said circuit connection including a plurality of pairs of contacts of the timing device and the contacts of both of said relays, a magnetic pick-up, a sensitive relay connected to the magnetic pick-up, an additional pair of closed contacts on said timing device, and a firing control circuit including the contacts of said sensitive and second relays and said additional pairs of contacts of the timing device.

14. In a system for arming and firing a marine mine, conduit means through which fluid is adapted to flow, a fluid pressure responsive switch positioned in the conduit means, a source of electromotive force, a capacitor, said switch and capacitor being connected across the source of electromotive force, a control circuit connected across the capacitor, a relay included in said control circuit in and operable in response to a current variation therein, a second relay, a detonator, an arming circuit for the detonator connected across the source of electromotive force and including the contacts of both of said relays, a normally charged second capacitor, circuit making and breaking means, and a firing control circuit for the detonator including said second capacitor, circuit making and breaking means, and the operating winding of said second relay.

15. In a system for arming and firing a marine mine, conduit means through which fluid is adapted to flow, a fluid pressure responsive switch positioned in the conduit means, a source of electromotive force, a capacitor, said switch and capacitor being connected across the source of electromotive force, a control circuit connected across the capacitor, a relay in said control circuit and operable in response to a current variation therein, a second relay, a detonator, an arming and firing circuit for establishing an operative electrical connection between the detonator and the source of electromotive force, said electrical connection including the contacts of both of said relays, a sensitive relay having a resetting winding, a normally charged second capacitor adapted to operate said second relay as the second capacitor is discharged, a pair of contacts on said sensitive relay for discharging the second capacitor as the sensitive relay operates, a firing control circuit including said second capacitor, the contacts of the sensitive relay, and the winding of said second relay, and a recharging circuit for the second capacitor connected across the source of electromotive force and including the resetting winding of the sensitive relay and the contacts of said second relay.

16. In a system for arming and firing a marine mine, conduit means through which fluid is adapted to flow, a fluid pressure responsive switch positioned in said conduit means, a source of electromotive force, a capacitor, said switch and capacitor being connected in series across the source of electromotive force, a detonator, an arming circuit for the detonator, a relay having a pair of contacts included in said arming circuit, a magnetically controlled operating circuit for the relay, a firing circuit for the detonator, a second relay having a pair of normally open contacts included in said firing circuit, and an operating circuit for said second relay connected across said capacitor and controlled by said pressure responsive switch.

17. In a system for arming and firing a marine mine, conduit means through which fluid is adapted to flow, a fluid pressure responsive switch positioned in said conduit means, a source of electromotive force, a normally charged capacitor, said switch and capacitor being connected in series across the source of electromotive force, a detonator, an arming circuit for the detonator constructed and arranged to be operated by energy discharged from said capacitor when the switch is operated, a relay having a pair of contacts included in the arming circuit, a magnetically controlled operating circuit for the relay, a second normally charged capacitor connected across said source of electromotive force, said second capacitor being included in said operating circuit and adapted to operate the relay on discharge thereof, and magnetically controlled means for discharging said second capacitor.

18. In a system for arming and firing a marine mine, conduit means through which fluid is adapted to flow, arming or firing means comprising a fluid pressure responsive switch positioned in said conduit means, a source of electromotive force, a capacitor, said switch and capacitor being connected in series across said source of electromotive force, a relay connected to said capacitor and adapted to be operated thereby, a pair of normally open contacts on said relay, a detonator, a circuit from one side of the source of electromotive force to one side of the detonator for arming or firing the mine, said normally open contacts being included in said arming and firing circuit, a second arming or firing circuit from the other side of said source of electromotive force to the other side of said detonator, a second relay having a pair of contacts included in said second arming or firing circuit, a control circuit for said second relay having a source of stored electrical energy therein, and means including a magnetic pick-up, included in said control circuit for arming or firing the mine by discharging said stored energy through said second relay.

19. In a system for arming and firing a marine mine, conduit means through which fluid is adapted to flow, arming or firing means comprising a fluid pressure responsive switch positioned in said conduit means, a source of electromotive force, a capacitor, said switch and capacitor being connected in series across said source of electromotive force, a relay connected to said capacitor, and adapted to be operated thereby, a pair of normally open contacts on said relay, a detonator, a circuit from one side of the source of electromotive force to one side of the detonator for arming or firing the mine, the contacts of said relay being included in said arming and firing circuit, a second arming or firing circuit from the other side of the source of electromotive force to the other side of said detonator, a second relay having a pair of contacts interposed in said second circuit, an operating circuit for said second relay, said operating circuit including a magnetic pick-up for arming or firing the mine, and a sensitive detecting relay controlled by said magnetic pick-up.

* * * * *